US008096021B2

(12) United States Patent
Iwama et al.

(10) Patent No.: US 8,096,021 B2
(45) Date of Patent: Jan. 17, 2012

(54) HINGE APPARATUS AND FOLDABLE ELECTRONIC DEVICE

(75) Inventors: Noriyuki Iwama, Higashiyamato (JP); Yuuichi Oota, Higashiyamato (JP); Satoshi Tanaka, Tachikawa (JP); Tomoaki Kawabata, Kawasaki (JP); Masatake Fuke, Fussa (JP); Nobuyoshi Ooba, Tachikawa (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 424 days.

(21) Appl. No.: 12/326,862

(22) Filed: Dec. 2, 2008

(65) Prior Publication Data

US 2009/0139058 A1 Jun. 4, 2009

(30) Foreign Application Priority Data

Dec. 3, 2007 (JP) ..... 2007-312650

(51) Int. Cl.
*E05D 3/10* (2006.01)

(52) U.S. Cl. ..... 16/367

(58) Field of Classification Search ..... 16/367, 16/338–340, 380, 330, 303; 361/679.06, 361/679.07, 679.11, 679.12; 379/433.12, 379/433.13; 455/575.1, 575.4, 575.8, 550.1, 455/90.3

See application file for complete search history.

(56) References Cited

U.S. PATENT DOCUMENTS

| | | | | |
|---|---|---|---|---|
| 7,380,313 | B2 * | 6/2008 | Akiyama et al. | 16/367 |
| 2004/0231105 | A1 * | 11/2004 | Ahn | 16/367 |
| 2005/0005399 | A1 * | 1/2005 | Lu et al. | 16/367 |
| 2006/0185123 | A1 * | 8/2006 | Kuramochi | 16/221 |
| 2008/0034549 | A1 * | 2/2008 | Lee et al. | 16/367 |
| 2008/0109996 | A1 * | 5/2008 | Hsu et al. | 16/367 |

FOREIGN PATENT DOCUMENTS

| | | |
|---|---|---|
| JP | 2005-188641 | 7/2005 |
| JP | 2006-233998 | 9/2006 |
| JP | 2006-242220 | 9/2006 |
| JP | 2007-177829 | 7/2007 |
| JP | 2008-138875 | 6/2008 |

* cited by examiner

*Primary Examiner* — Chuck Y. Mah
(74) *Attorney, Agent, or Firm* — Cozen O'Connor

(57) ABSTRACT

A hinge apparatus of the present invention comprises a first rotational shaft which rotates a first casing and a second casing relative to each other from a state where the first and second casings are folded down, and opens the first and second casings in a vertical direction, a second rotational shaft which rotates the first casing and the second casing relative to each other in a horizontal direction, a coupling member which couples the first rotational shaft and the second rotational shaft together, with an end portion of the first rotational shaft being overlapped with an end portion of the second rotational shaft, and an engagement member which allows either one rotational shaft of the first rotational shaft and the second rotational shaft to engage with the other rotational shaft, thereby restricting a rotation of the other rotational shaft when the one rotational shaft rotates.

13 Claims, 34 Drawing Sheets

HINGE APPARATUS AND FOLDABLE ELECTRONIC DEVICE

BACKGROUND OF THE INVENTION

1. Field of the Invention

The present invention relates to a biaxial type hinge apparatus and a foldable electronic device having that hinge apparatus.

2. Description of the Related Art

There are known foldable cellular phone devices which can fold a display unit and a main body with respect to each other, and can rotate the display unit. In regard to such foldable cellular phone devices, Unexamined Japanese Patent Application KOKAI Publication No. 2005-188641, and Unexamined Japanese Patent Application KOKAI Publication No. 2007-177829 disclose the following technologies: a technology which allows the display unit to rotate with a restriction unit being released when a folded state is released and the display unit is at a predetermined angle relative to the main body; and a technology which restricts any folding of the display unit when the display unit is in a rotatable state.

The foregoing publications disclose a foldable cellular phone device having a biaxial hinge, and a rotation motion and a folding motion are restricted. The biaxial hinge means a hinge which allows rotation motions in two directions. An example of the biaxial hinge is one which allows a first casing and a second casing to open or rotate relative to each other in a vertical direction and a horizontal direction from the state where the first and second casings are folded down. According to such a cellular phone device, however, in order to restrict motions in the two directions in accordance with respective states, individual mechanisms for each of the motion directions are required. Therefore, the hinge mechanism becomes complex and becomes larger and larger.

SUMMARY OF THE INVENTION

It is an object of the present invention to provide a biaxial type hinge apparatus which can restrict rotation motions in two directions relative to each other with a simple structure without increasing a size.

To achieve the object, a hinge apparatus of the present invention comprises:

a first rotational shaft which rotates a first casing and a second casing relative to each other from a state where the first and second casings are folded down, and opens the first and second casings in a vertical direction;

a second rotational shaft which rotates the first casing and the second casing relative to each other in a horizontal direction;

a coupling member which couples the first rotational shaft and the second rotational shaft together, with an end portion of the first rotational shaft being overlapped with an end portion of the second rotational shaft; and an engagement member which allows either one of the rotational shafts of the first rotational shaft and the second rotational shaft to engage with the other rotational shaft, thereby restricting a rotation of the other rotational shaft when the one rotational shaft rotates.

According to the present invention, rotations of a rotational shaft which allows a casing to rotate in a vertical direction or a horizontal direction can be restricted with a simple structure without increasing the size of a hinge.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENTS

Hereinafter, preferred embodiments for carrying out the present invention will be explained in detail with reference to the accompanying drawings.

First Embodiment

Figure 1:
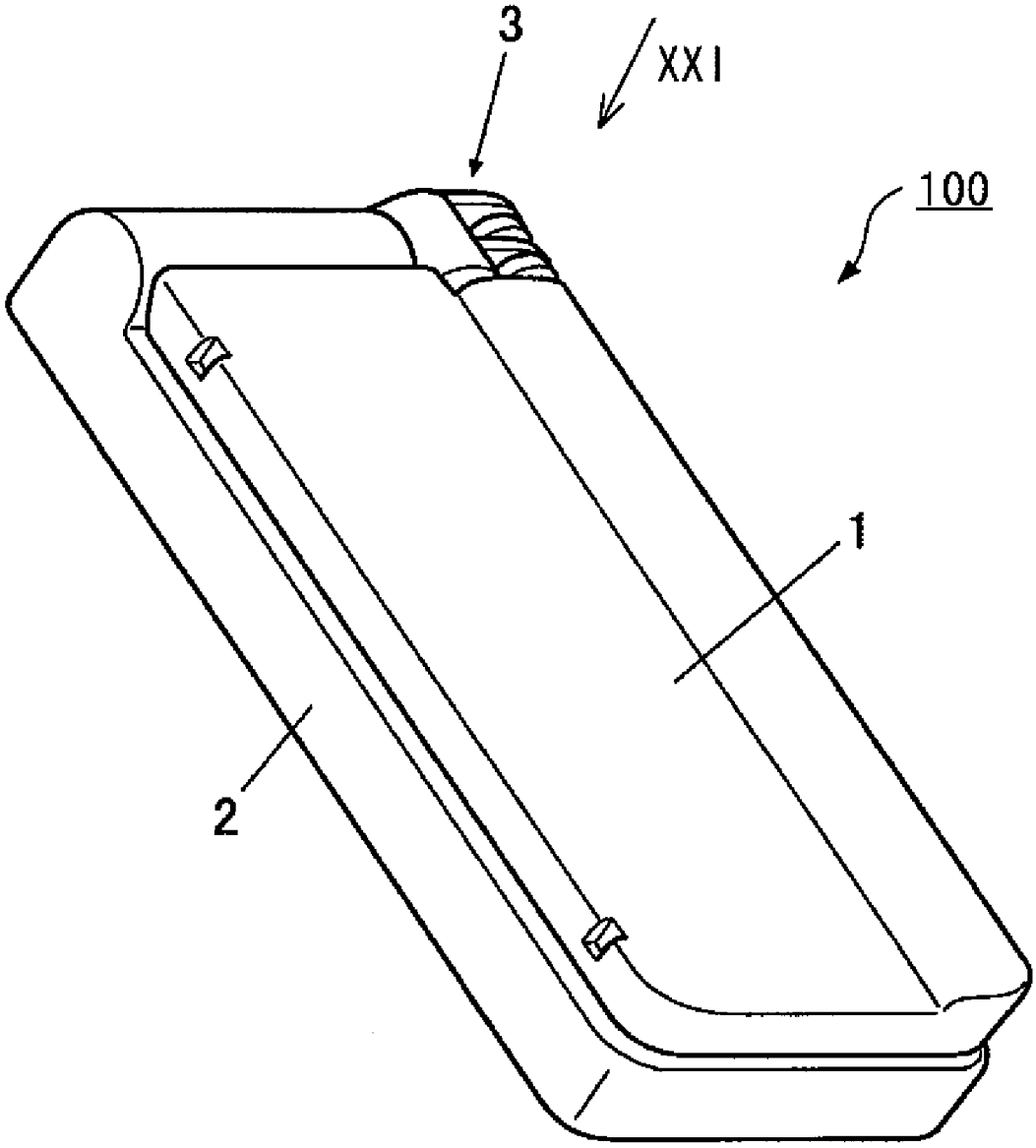
FIG. 1 is a perspective view showing the structure of a foldable electronic device having a hinge apparatus according to the first embodiment of the present invention, with a cellular phone device being folded down.
Figure 2:
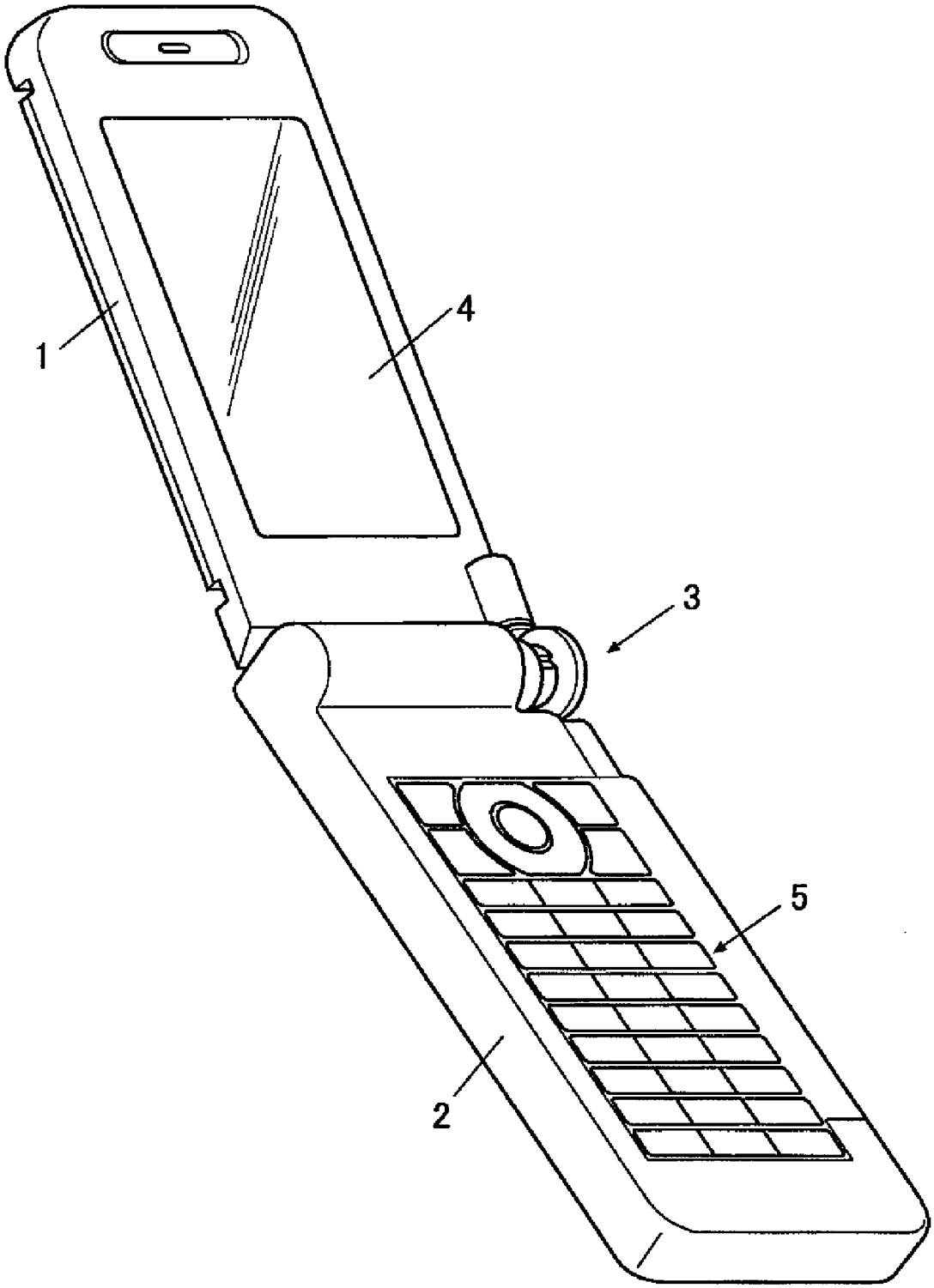
FIG. 2 is a perspective view showing the cellular phone device opened in the vertical direction.
Figure 3:
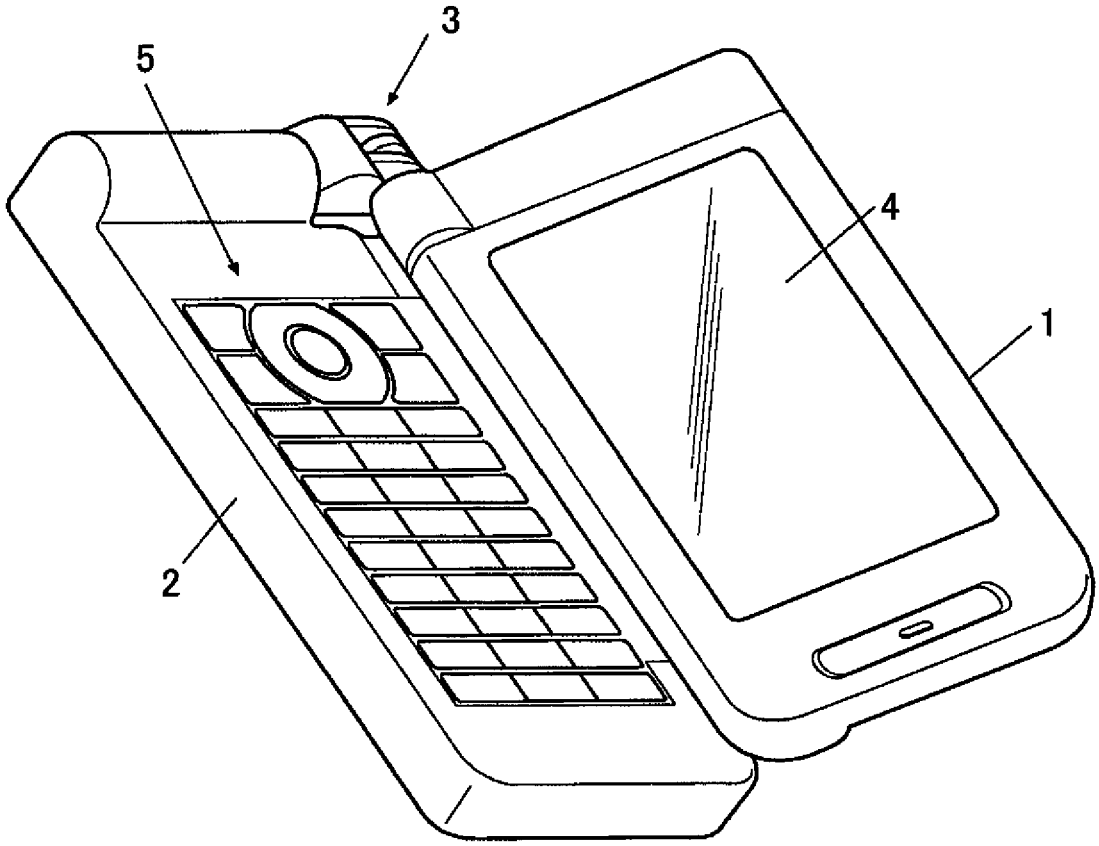
FIG. 3 is a perspective view showing the cellular phone device opened in the horizontal direction.

As shown in FIGS. 1 to 3, a cellular phone device 100 has a first casing 1, a second casing 2, and a biaxial hinge member 3. The first casing 1 and the second casing 2 are coupled together in a foldable manner, and can open in the vertical and horizontal directions via the biaxial hinge member 3 which is the hinge apparatus of the present invention. The first casing 1 is provided with a display unit 4, and the second casing 2 is provided with an operation unit 5.

Figure 32:
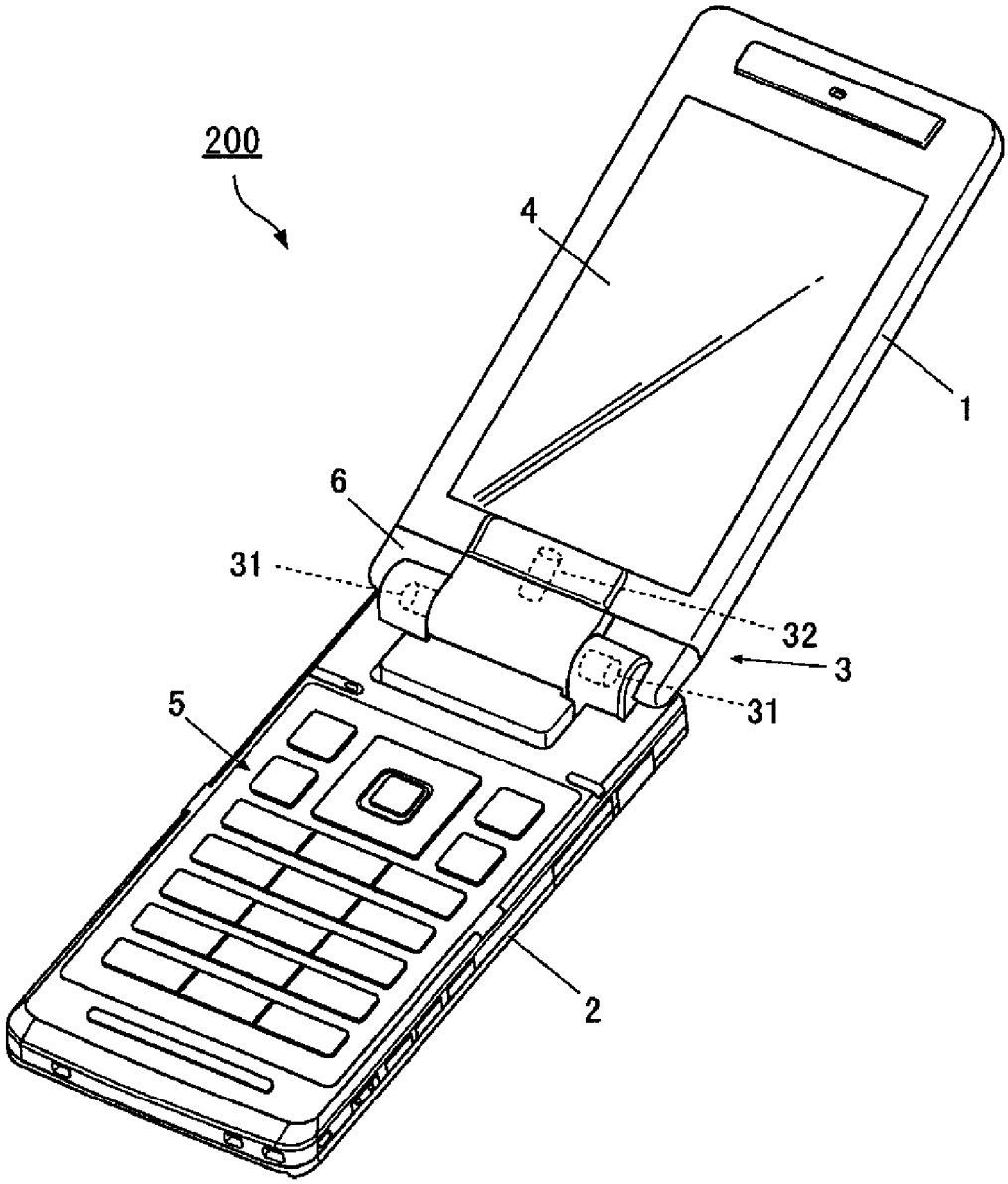
FIG. 32 is a perspective view showing a modified example of a cellular phone device.
Figure 33:
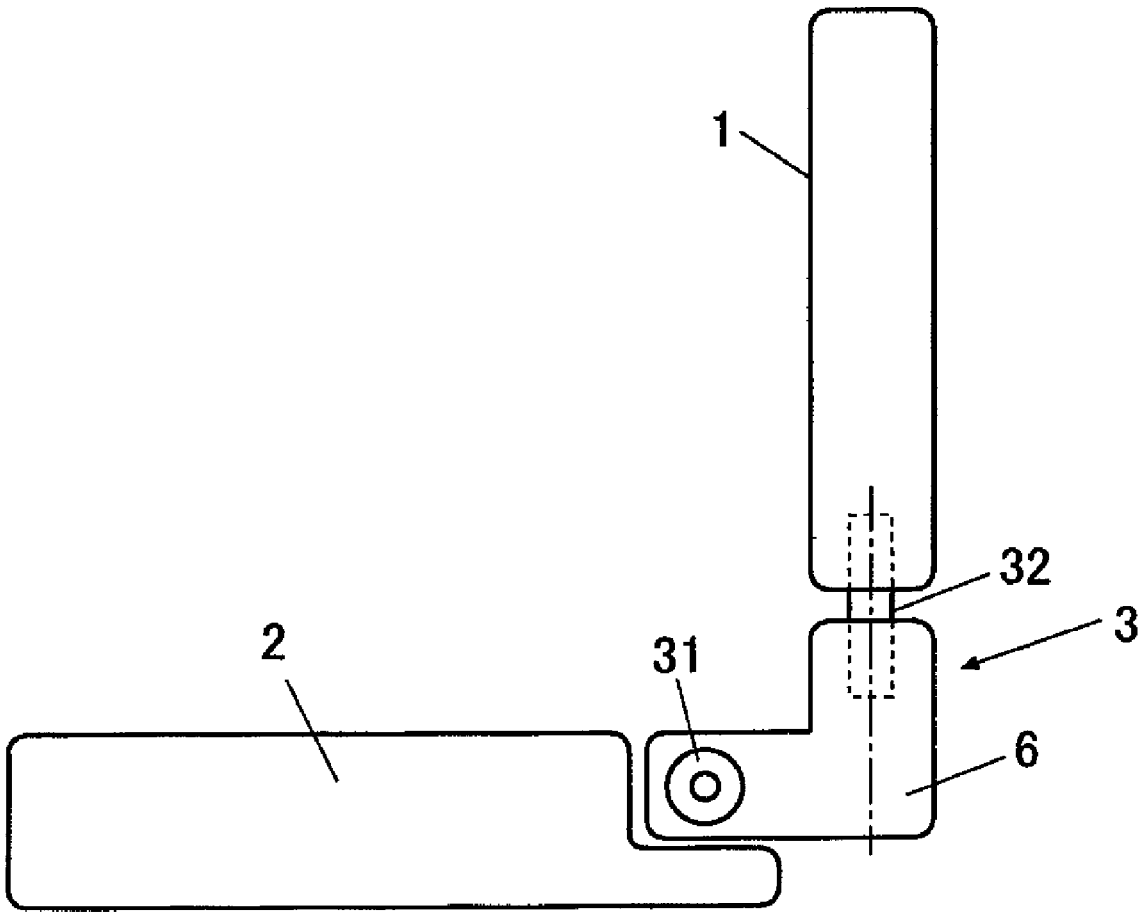
FIG. 33 is a schematic side view showing another structure of the rotational shaft of a biaxial hinge part.
Figure 34:
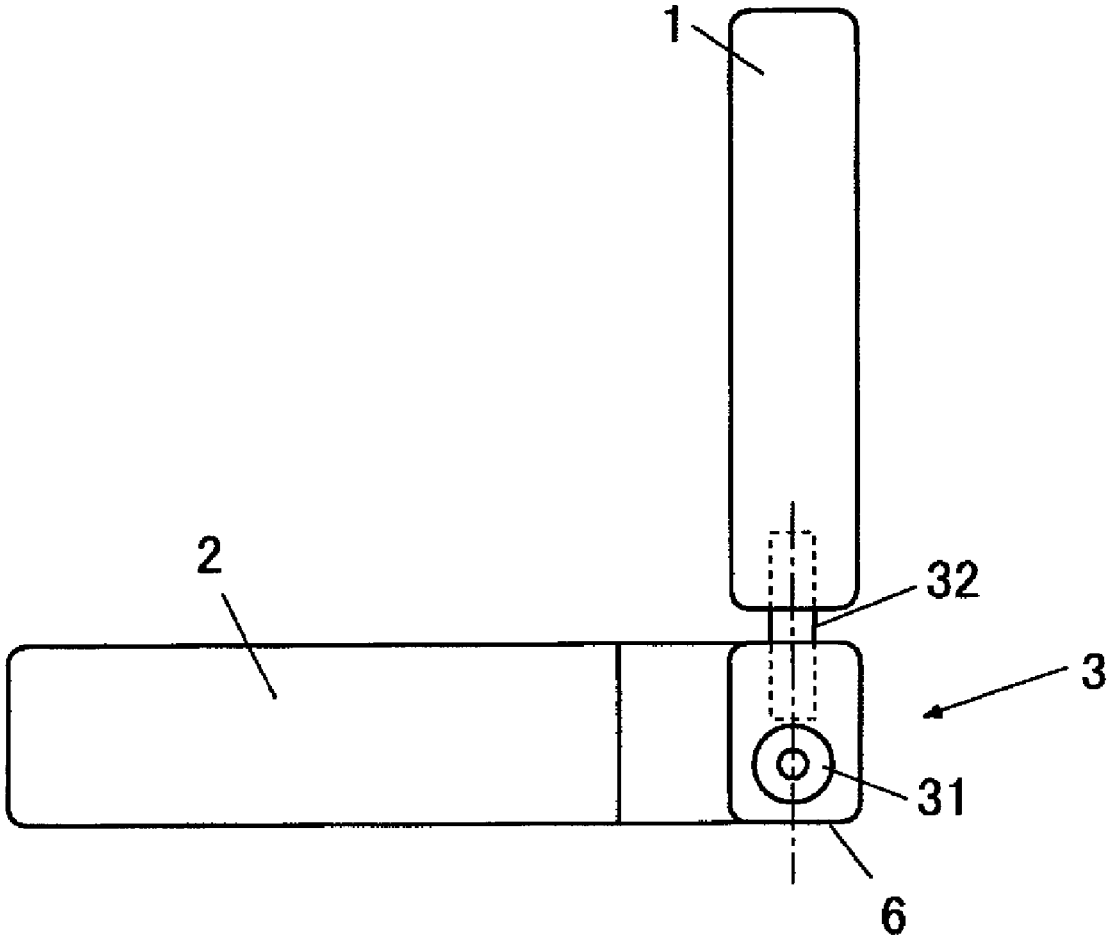
FIG. 34 is a schematic side view showing another structure of the rotational shaft of the biaxial hinge part.

In this specification, motion directions of the casing (first casing 1 or second casing 2) or the biaxial hinge member 3 are expressed as the "vertical direction" or the "horizontal direction" as follows. "Opening in the vertical direction" or "rotating in the vertical direction" means that the first casing 1 and the second casing 2 are arranged in the vertical direction in a main use state of the cellular phone device 100. That is, those expressions mean that the first casing 1 and the second casing 2 go into a state shown in FIG. 2 when opened. Moreover, "opening in the horizontal direction" or "rotating in the horizontal direction" means that the first casing 1 and the second casing 2 are arranged in the horizontal direction in a main use state of the cellular phone device 100. That is, those expressions mean that the first casing 1 and the second casing 2 go into a state shown in FIG. 3 when opened. A motion in the "horizontal direction" includes a rotation of the second casing 2 around a rotational shaft in the vertical direction relative to the first casing 1 as shown in FIGS. 32 to 34.

Figure 4:
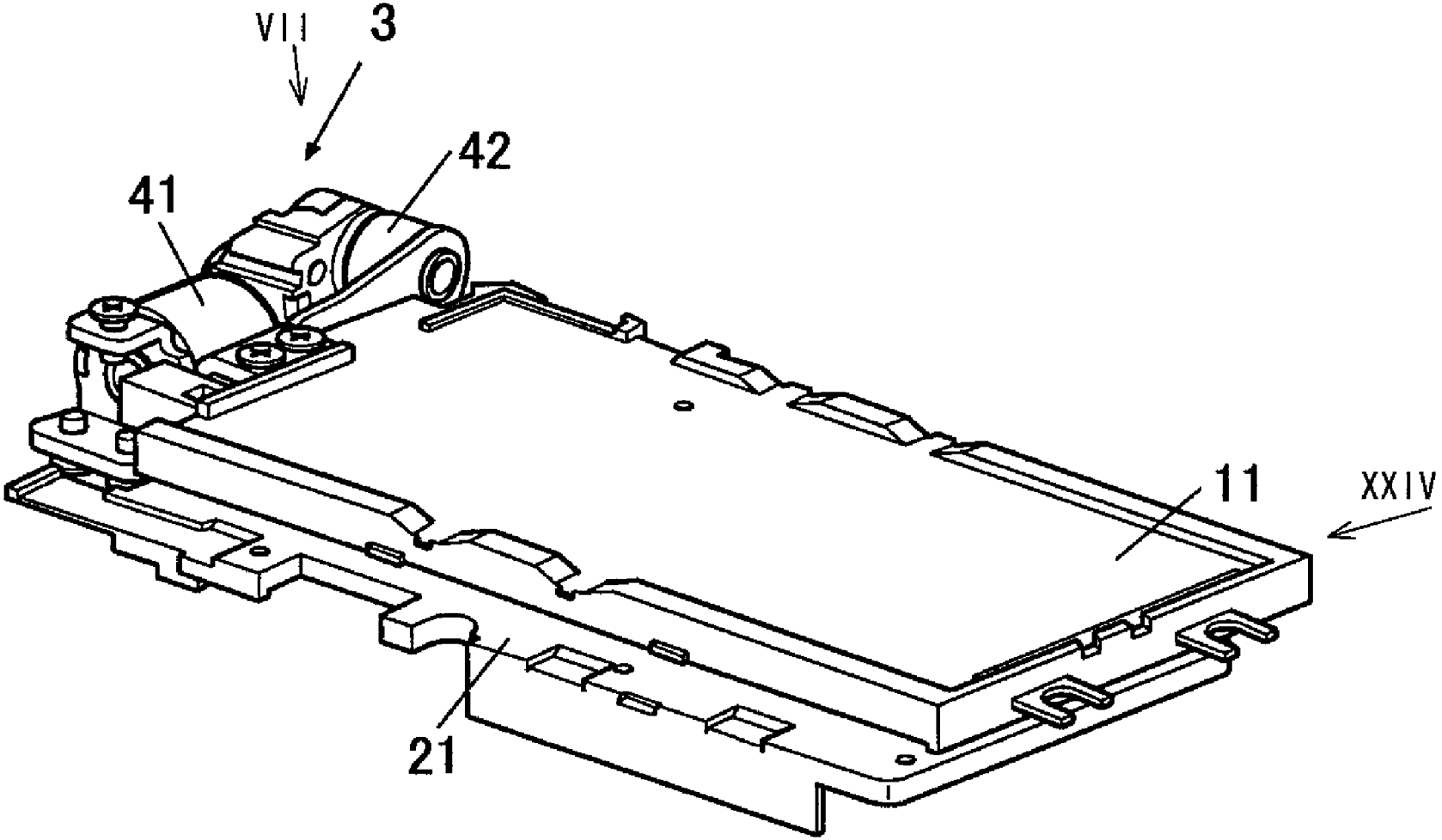
FIG. 4 is a perspective view showing an inner casing and a hinge mechanism in the folded state shown in FIG. 1.
Figure 5:
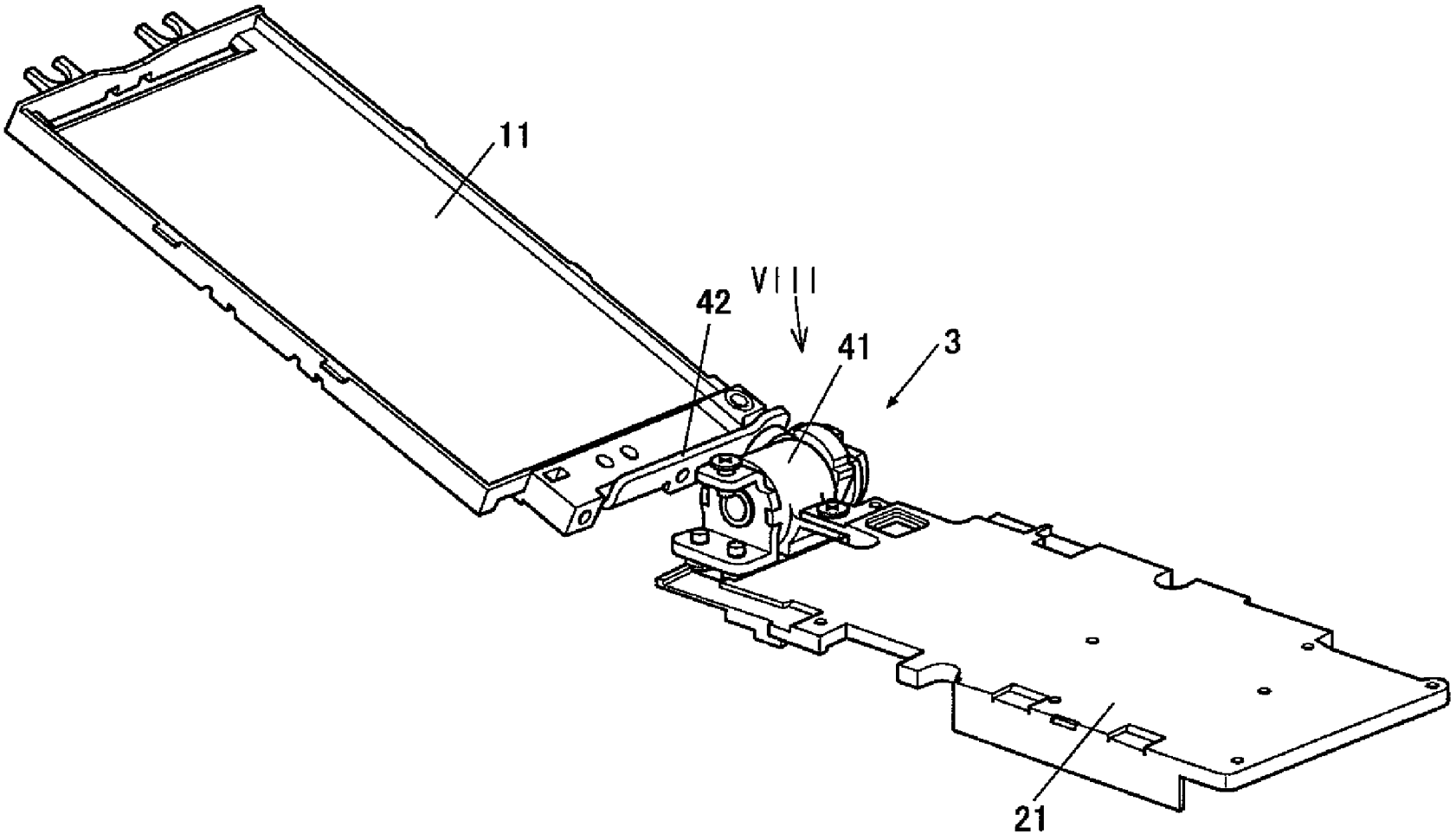
FIG. 5 is a perspective view showing the inner casing and the hinge mechanism in the open state shown in FIG. 2.
Figure 6:
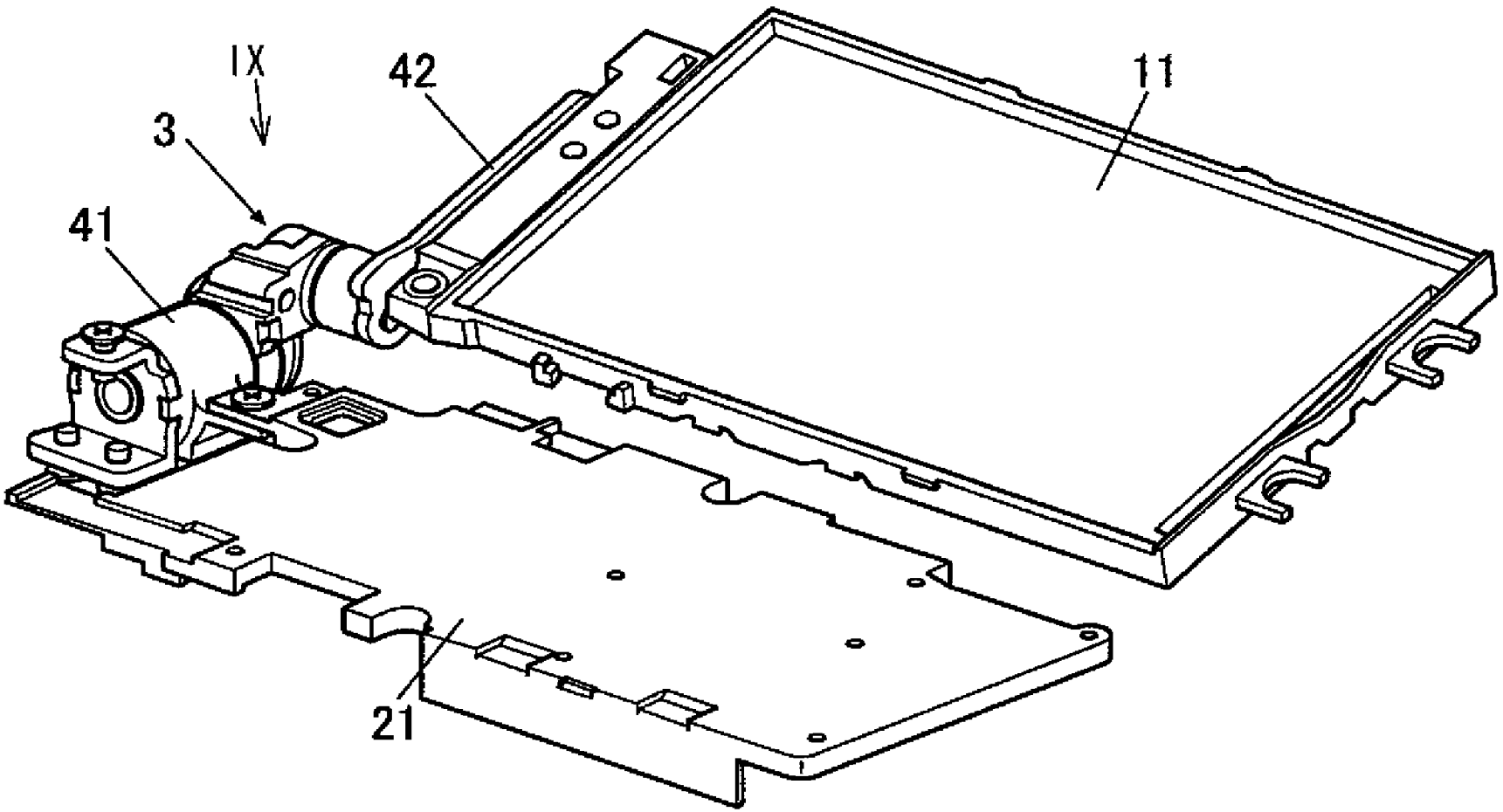
FIG. 6 is a perspective view showing the inner casing and the hinge mechanism in the open state shown in FIG. 3.

FIGS. 4 to 6 show the internal structure of the cellular phone device 100. FIG. 4 corresponds to a folded state in FIG. 1. FIG. 5 corresponds to an open state in the vertical direction shown in FIG. 2. FIG. 6 corresponds to an open state in the horizontal direction shown in FIG. 3. As shown in the figures, an inner casing 11 of the first casing 1 and an inner casing 21 of the second casing 2 are coupled together via the biaxial hinge member 3. Specifically, the inner casing 11 is fixed to a second attachment part 42 of the biaxial hinge member 3, and the inner casing 21 is fixed to a first attachment part 41 of the biaxial hinge member 3.

Figure 7:
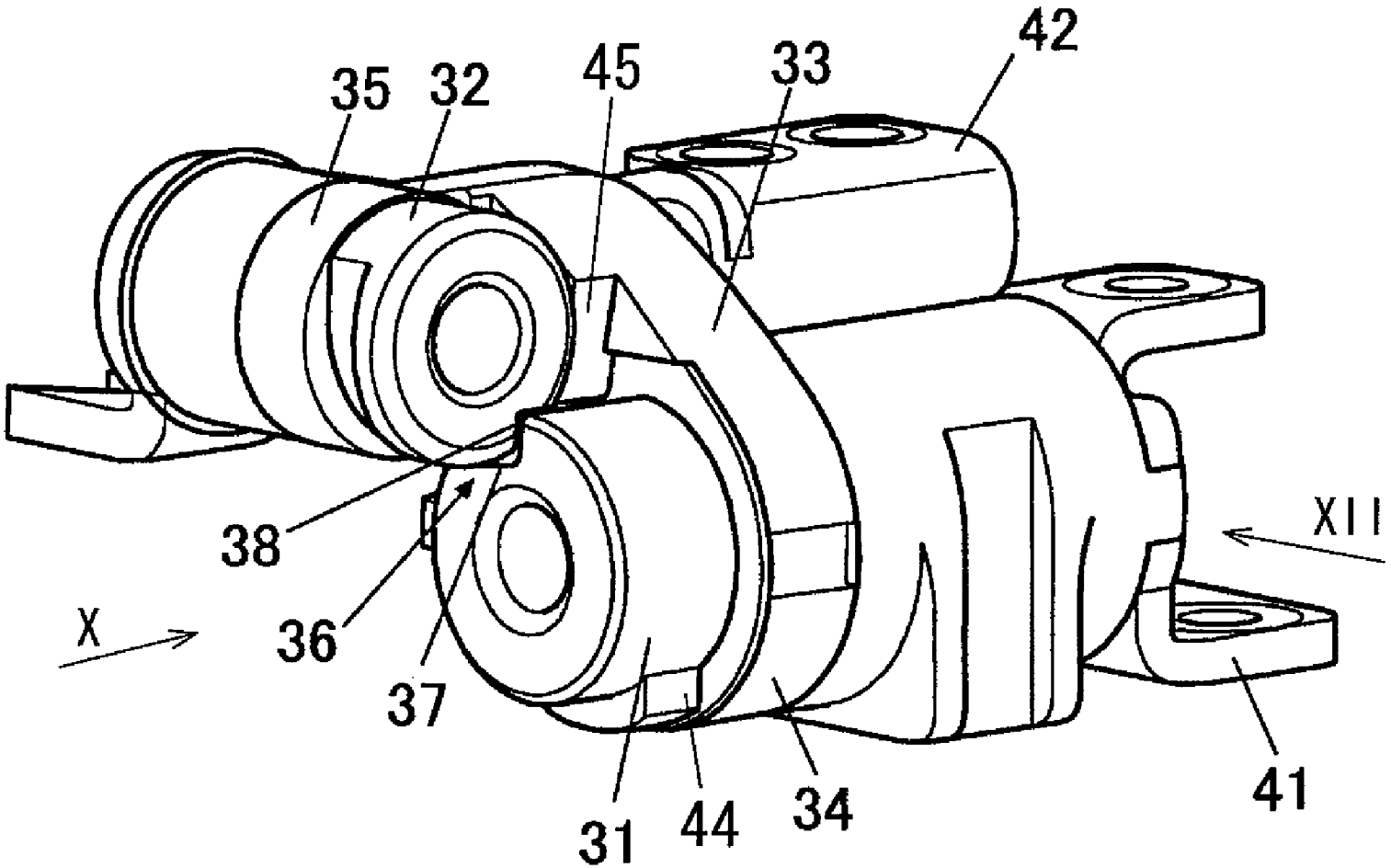
FIG. 7 is a perspective view showing the hinge mechanism in FIG. 4 enlarged as viewed from a direction of an arrow VII.
Figure 8:
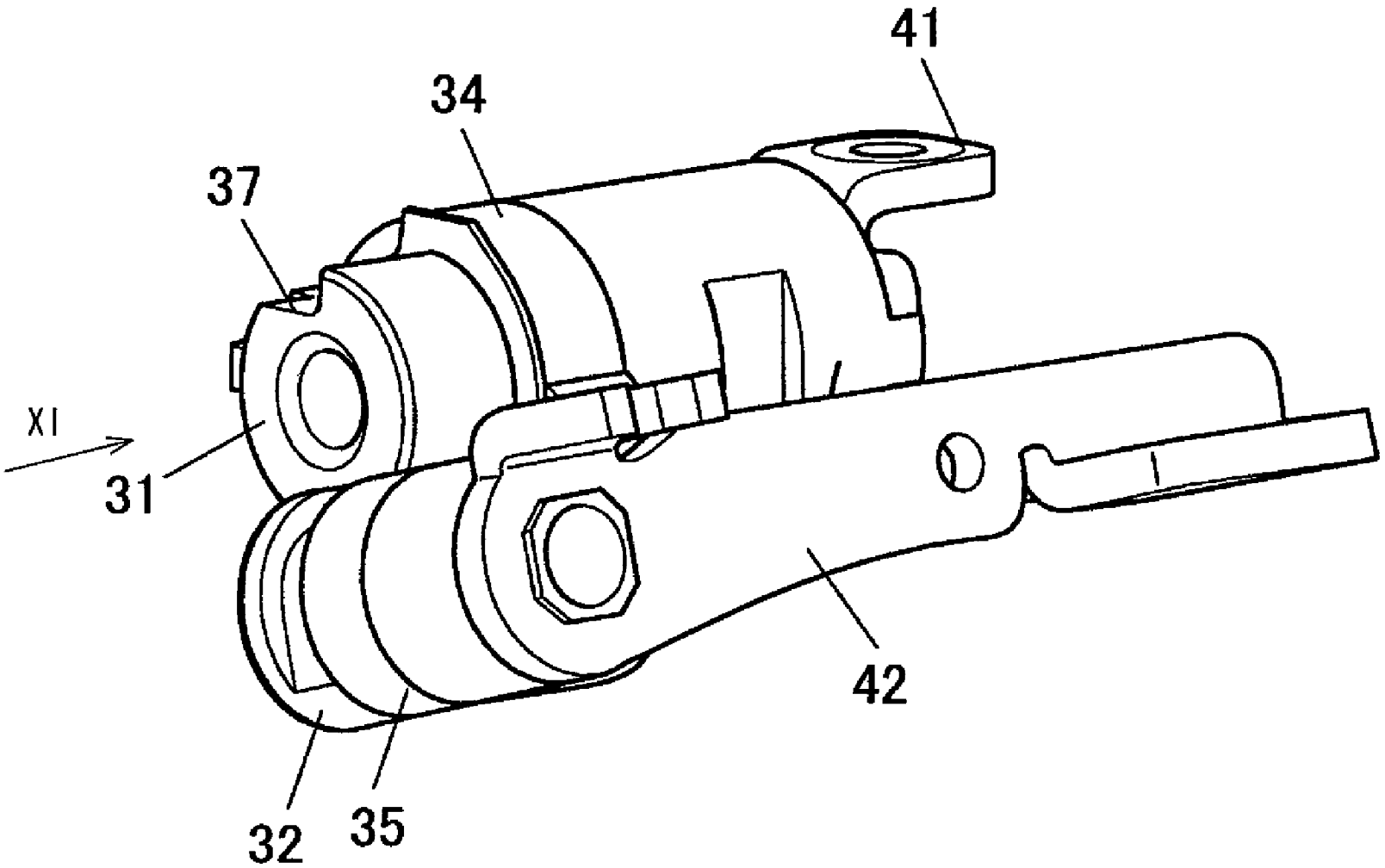
FIG. 8 is a perspective view showing the hinge mechanism in FIG. 5 enlarged as viewed from a direction of an arrow VIII.
Figure 9:
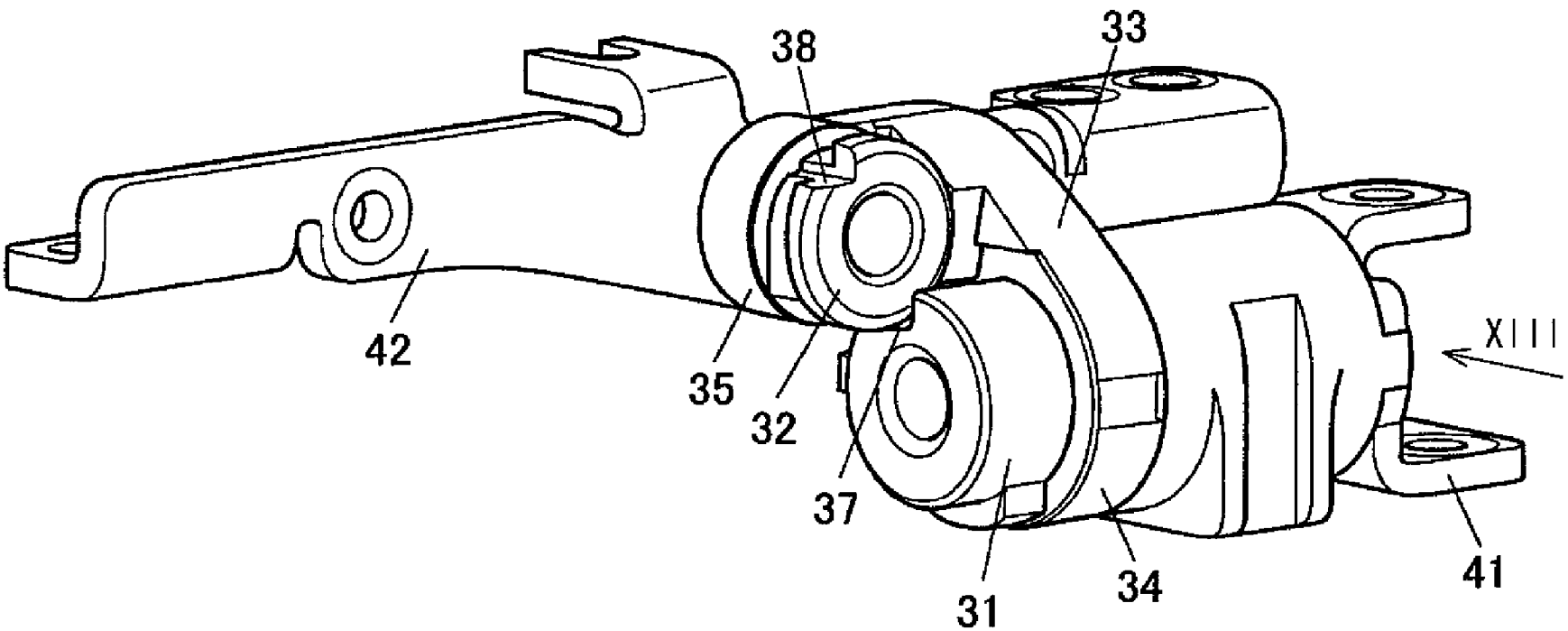
FIG. 9 is a perspective view showing the hinge mechanism in FIG. 6 enlarged as viewed from a direction of an arrow IX.

As shown in FIGS. 7 to 9, the biaxial hinge member 3 has a first rotational shaft 31, a second rotational shaft 32, a coupling member 33, the first attachment part 41 and the second attachment part 42.

The first rotational shaft 31 has a non-illustrated shaft member passing all the way through a first shaft receiving part 34 of coupling member 33 and the hole of the first attachment part 41, and fixed to the first attachment part 41. The first rotational shaft 31 has a notch 37, L-shaped as viewed from the axial direction, and a stopper 44 at an exposed part in FIG. 7.

The second rotational shaft 32 has a non-illustrated shaft member passing all the way through a second shaft receiving part 35 of the coupling member 33 and the hole of the second attachment part 42, and fixed to the second attachment part 42. The second rotational shaft 32 has a notch 38, L-shaped as viewed from the axial direction, at an exposed part in FIG. 7.

The coupling member 33 has the first shaft receiving part 34 and the second shaft receiving part 35. The first and second shaft receiving parts 34, 35 respectively have circular holes, and the axial directions of the respective holes are at right angles to each other. The coupling member 33 further has a stopper 45.

The first attachment part 41 is U-shaped and formed at the leading end side of the non-illustrated shaft member of the first rotational shaft 31, and has an attachment member having two holes as illustrated. Via the attachment members the inner casing 11 is fixed to the first attachment part 41 by screwing.

The second attachment part 42 is basically formed in a bar like shape at the leading end side of the non-illustrated shaft member of the second rotational shaft 32, and has an attachment member having two holes as illustrated, with a part bent but protruding. The inner casing 21 is fixed to the second attachment part 42 via the attachment member by screwing.

The first rotational shaft 31 and the second rotational shaft 32 intersect at right angles with each other with the end portions thereof being overlapped, and are respectively rotatably supported by the coupling member 33. That is, the first rotational shaft 31 is rotatably supported by the first shaft receiving part 34, and the second rotational shaft 32 is rotatably supported by the second shaft receiving part 35. The rotational axis of the first rotational shaft 31 and the rotational axis of the second rotational shaft 32 intersect at right angles with each other.

In the biaxial hinge member 3 having the foregoing structure, the first rotational shaft 31 and the second rotational shaft 32 have respective end portions intersecting at right angles and overlapped with each other at an engagement part 36. That is, the engagement part 36 comprises the notch 37 formed at the outer circumference of the end portion of the first rotational shaft 31, and the notch 38 formed at the outer circumference of the end portion of the second rotational shaft 32. These notches 37, 38 have internal surfaces perpendicular to each other in the circumferential direction in order to allow the rotational shafts 31, 32 to rotate. That is, in the folded state shown in FIG. 7, as the second rotational shaft 32 is provided with the notch 38, the first rotational shaft 31 can freely rotate without interfering with the second rotational shaft 32. Likewise, as the first rotational shaft 31 is provided with the notch 37, the second rotational shaft 32 can freely rotate without interfering with the first rotational shaft 31.

As shown in FIG. 7, in the folded state, the cellular phone device 100 is maintained in a state that the notch 37 of the first rotational shaft 31 and the notch 38 of the second rotational shaft 32 face each other.

When the inner casing 11 of the first casing 1 and the inner casing 21 of the second casing 2 are opened in the vertical direction, the first rotational shaft 31 rotates relative to the first shaft receiving part 34. Accordingly, the cellular phone device 100 goes into a state shown in FIGS. 5 and 8. During this operation, the rotation of the second rotational shaft 32 is restricted with the first rotational shaft 31 being engaged with the notch 38.

Figure 10:
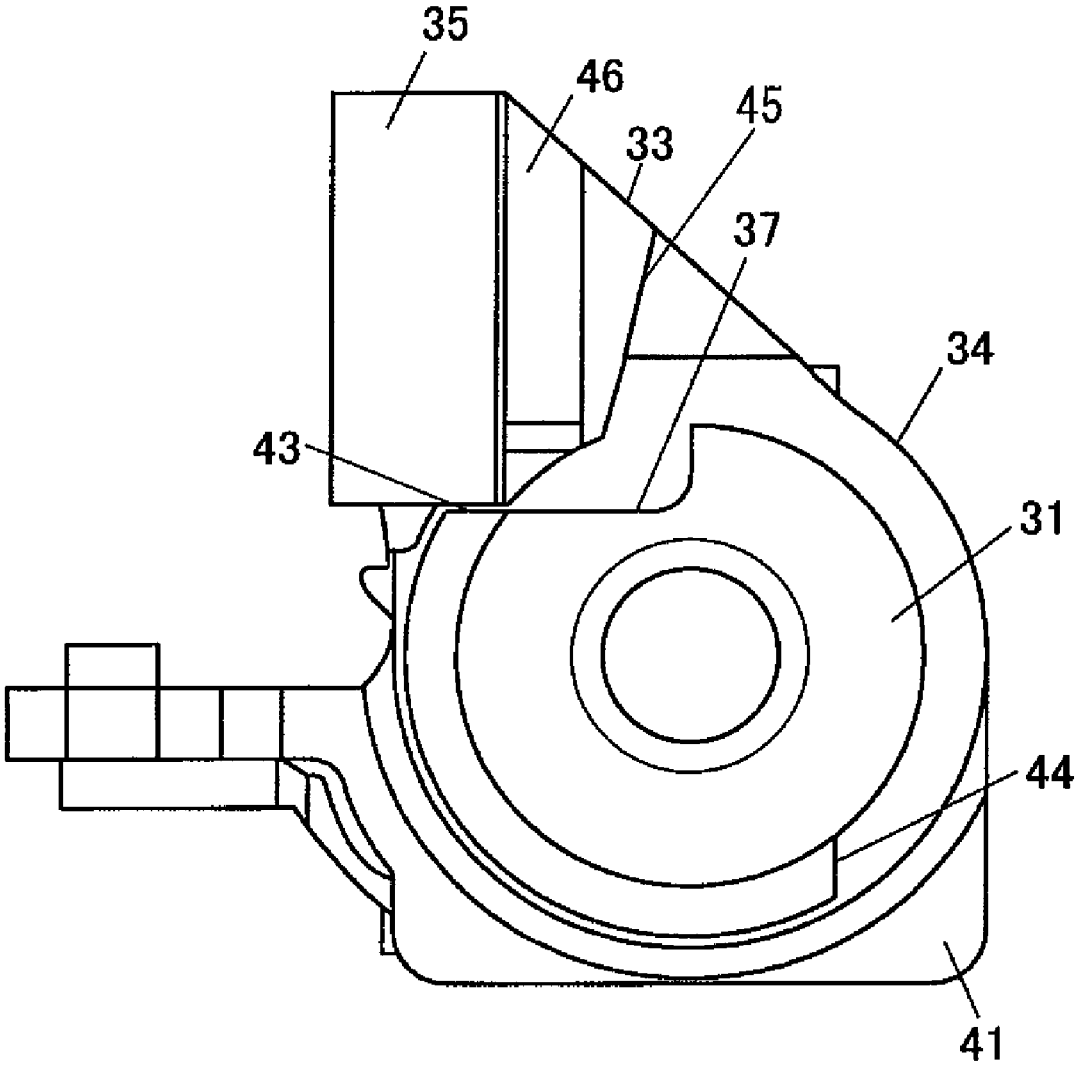
FIG. 10 is a side view showing the hinge mechanism in FIG. 7 enlarged as viewed from a direction of an arrow X.
Figure 11:
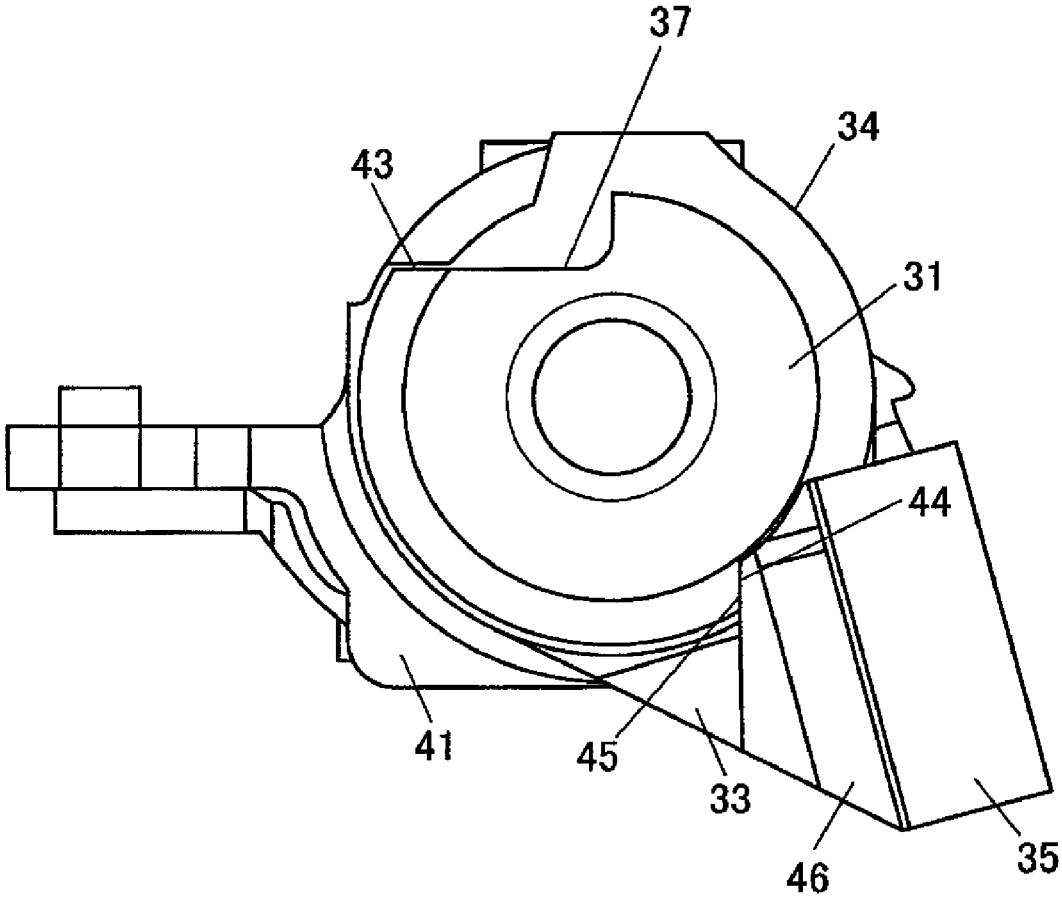
FIG. 11 is a side view showing the hinge mechanism in FIG. 8 enlarged as viewed from a direction of an arrow XI.

A rotation in the vertical direction is carried out within the following range from limit to limit as shown below. One limit is a folded state where the outer circumference of the second shaft receiving part 35 of the coupling member 33 abuts a stopper 43 of the first rotational shaft 31 as shown in FIG. 10. The stopper 43 is protrudingly provided on the outer circumference of the first rotational shaft 31, and in the illustrated example, is provided at an extended part of the one inner surface of the notch 37. The other limit is a vertical-direction opened state where the stopper 44 of the first rotational shaft 31 and the stopper 45 of the coupling member 33 abut each other as shown in FIG. 11. In the illustrated example, the stopper 45, provided at the middle part of the coupling member 33, abuts the stopper 44, provided on the outer circumference of the first rotational shaft 31 and provided at a position opposite to the notch 37 in the diametrical direction.

When the casings, i.e., the inner casing 11 and the inner casing 21 are opened in the horizontal direction, the second rotational shaft 32 rotates relative to the second shaft receiving part 35. Accordingly, the cellular phone device 100 goes into a state shown in FIGS. 6 and 9. During this operation, the rotation of the first rotational shaft 31 is restricted with the second rotational shaft 32 being engaged with the notch 37.

Figure 12:
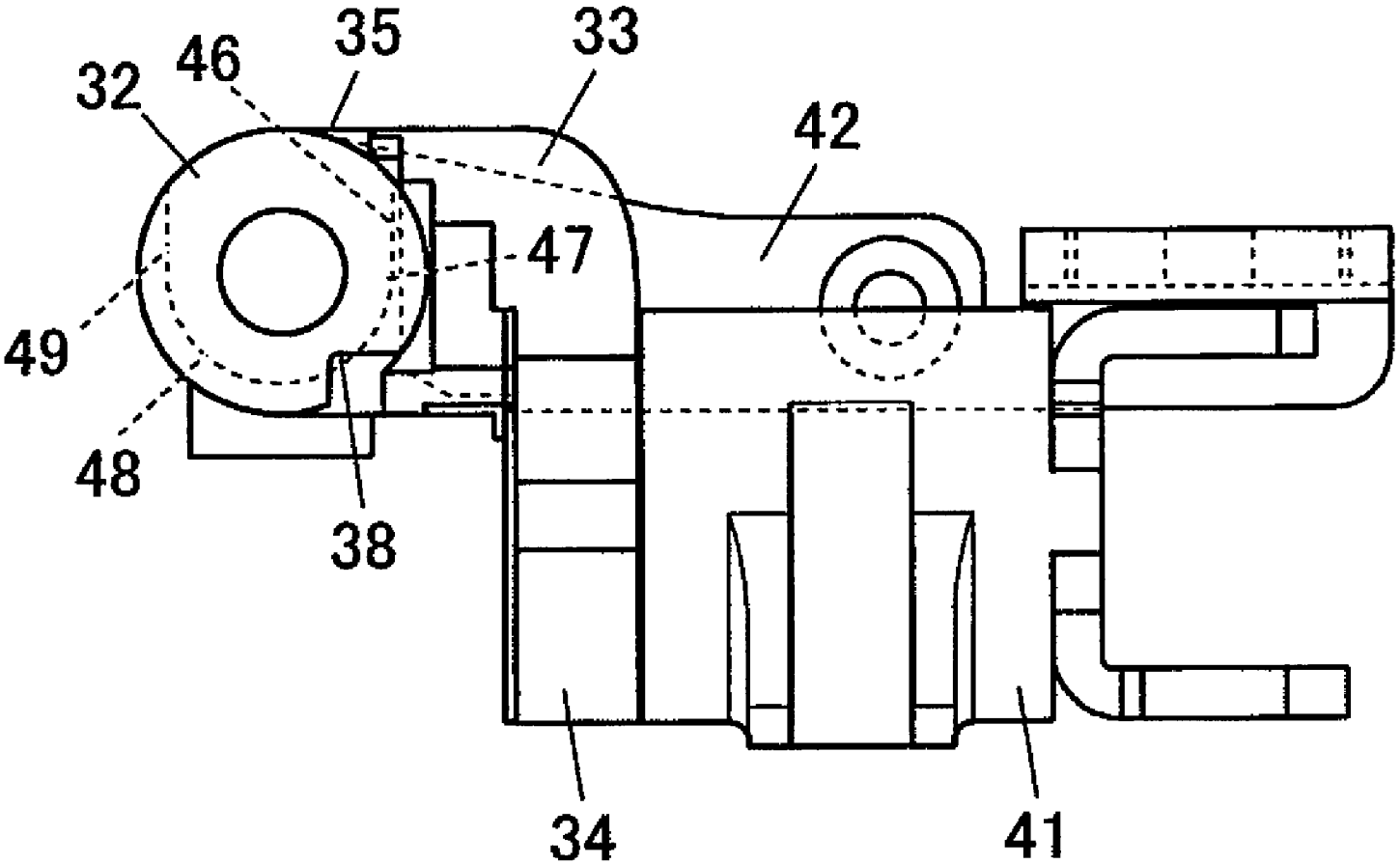
FIG. 12 is a front view showing the hinge mechanism in FIG. 7 as viewed in a direction of an arrow XII.
Figure 13:
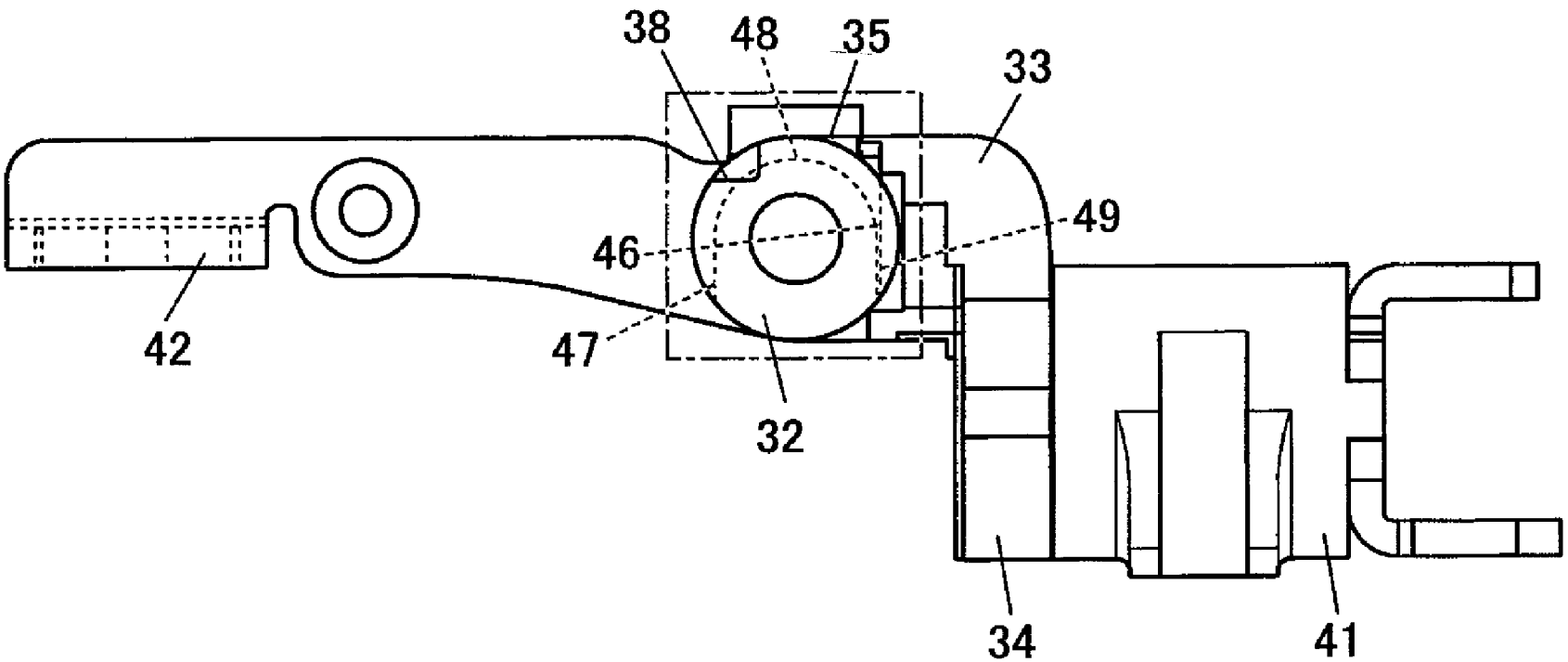
FIG. 13 is a front view showing the hinge mechanism in FIG. 9 as viewed in a direction of an arrow XIII.
Figure 14:
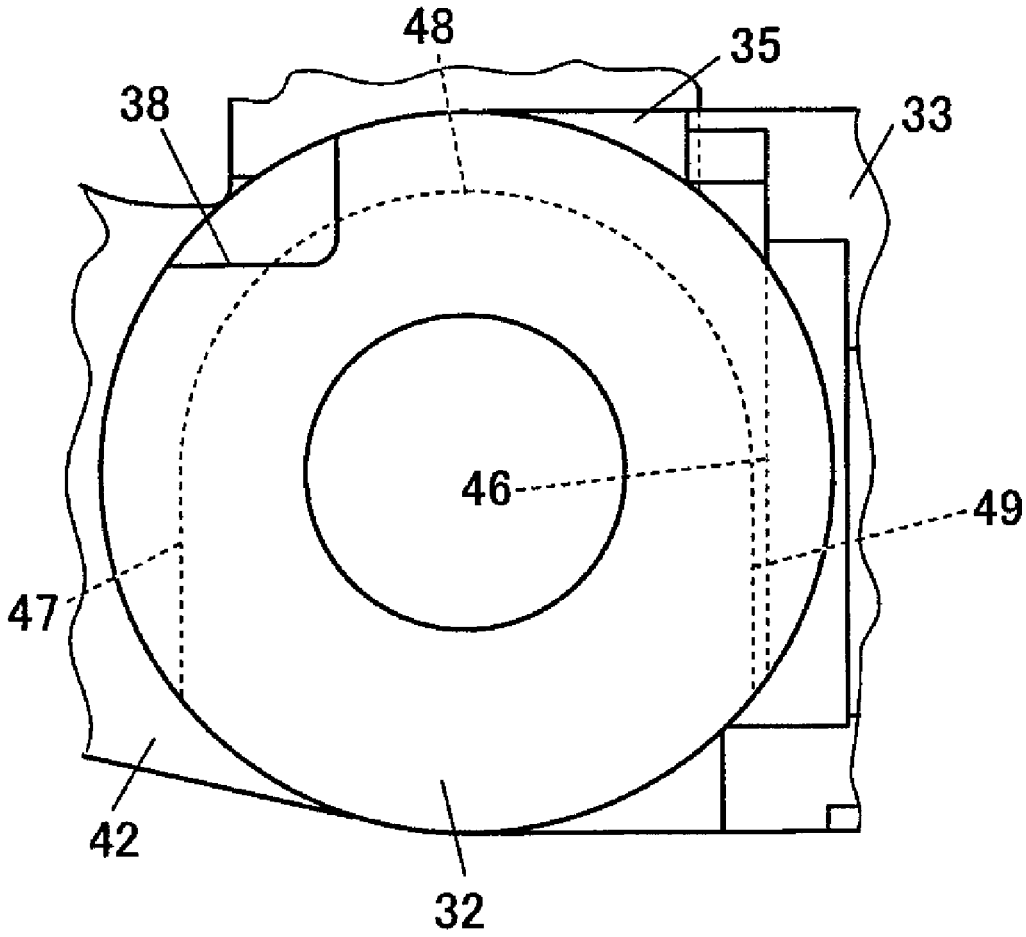
FIG. 14 is an enlarged view showing a second rotational shaft in FIG. 13.

A rotation in the horizontal direction is carried out within a range from limit to limit as shown below. One limit is a folded state where a stopper 47 of the second rotational shaft 32 abuts a stopper 46 of the coupling member 33 as shown in FIG. 12. The stopper 46 is provided at the coupling member 33, and the surface of the stopper 46 extends toward the center of the second shaft receiving part 35. The stopper 47 is a surface of a step which forms a U-shaped groove as viewed from the axial direction when the second rotational shaft 32 abuts the second shaft receiving part 35. The other limit is a horizontal-direction open state where a stopper 49 of the second rotational shaft 32 abuts the stopper 46 of the coupling member 33 as shown in FIGS. 13 and 14. The stopper 49 is a surface which faces the stopper 47 at the step provided on the second rotational shaft 32.

Figure 15B:
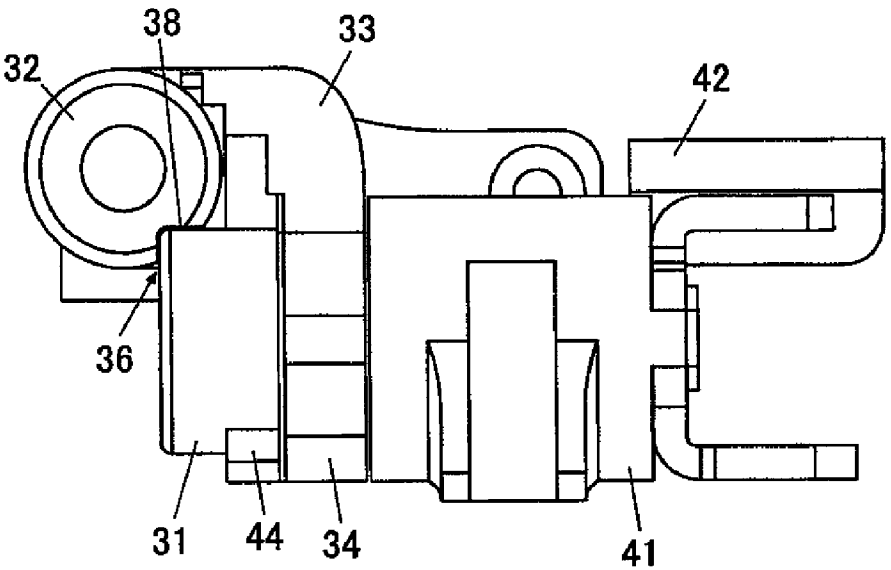
FIG. 15B is a front view showing the hinge mechanism in FIG. 7 as viewed from the direction of the arrow XII.
Figure 15A:
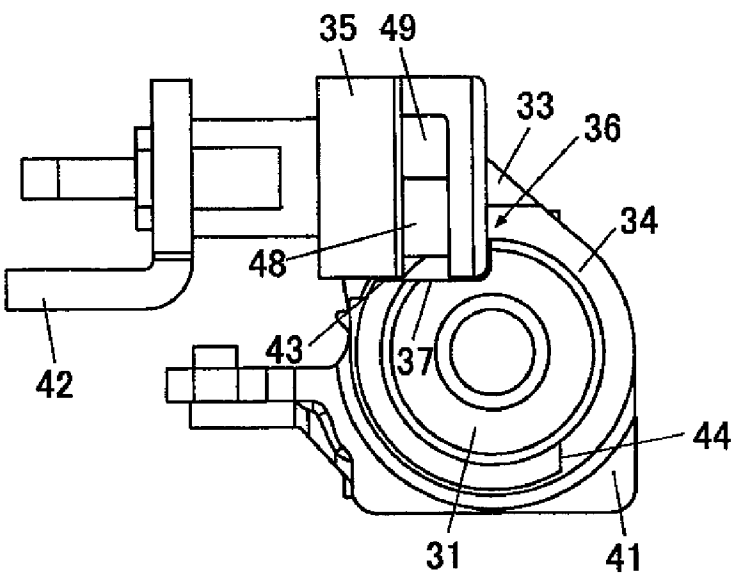
FIG. 15A is a side view showing the hinge mechanism in FIG. 7 as viewed from the direction of the arrow X.
Figure 16B:
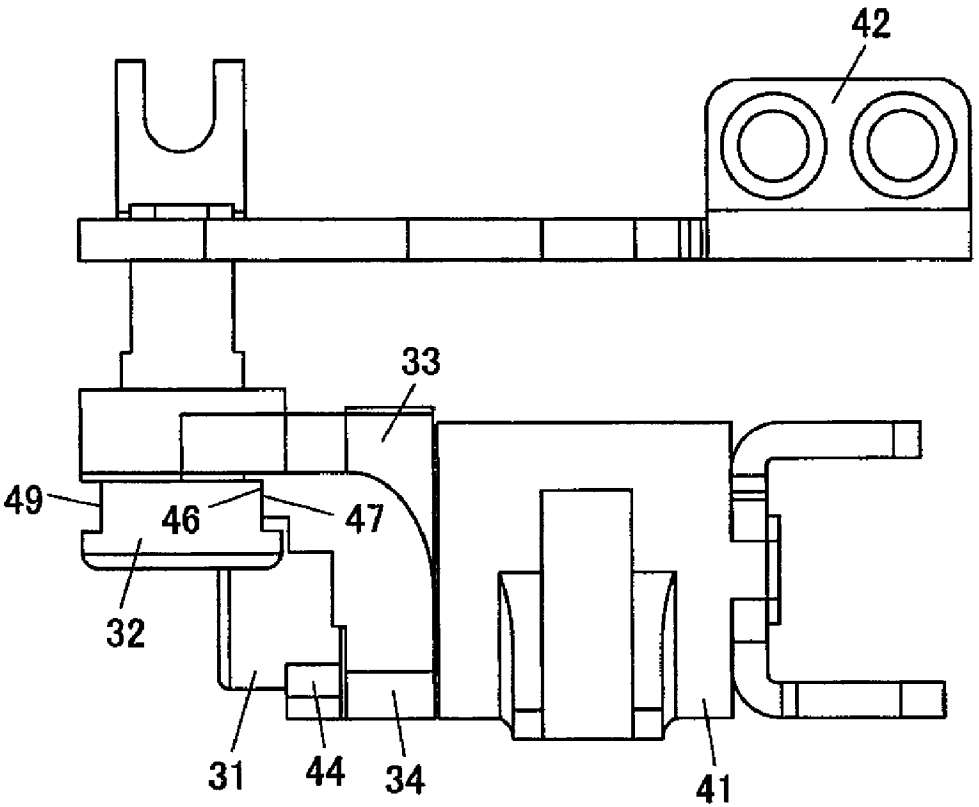
FIG. 16B is a front view showing the hinge mechanism rotated in the vertical direction and corresponding to FIG. 15B.
Figure 16A:
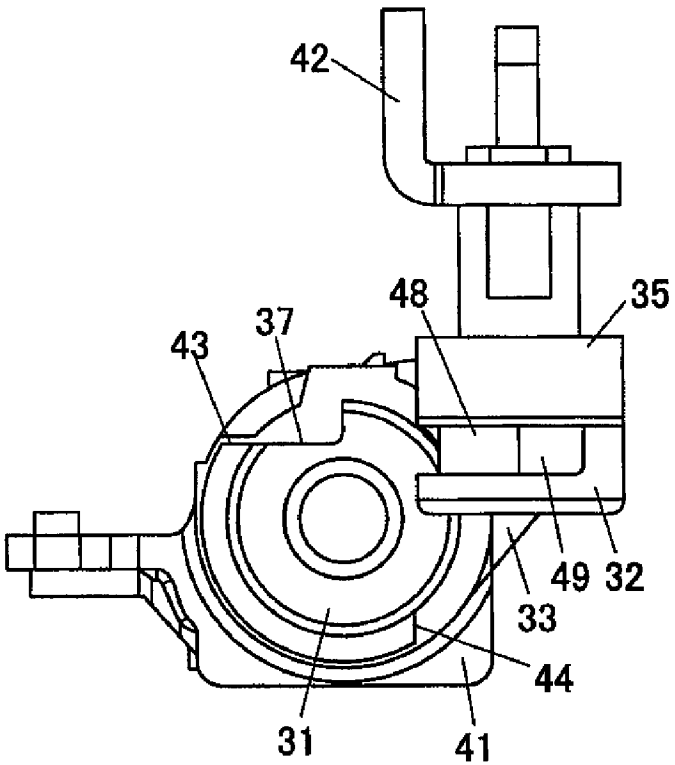
FIG. 16A is a side view showing the hinge mechanism rotated in the vertical direction and corresponding to FIG. 15A.
Figure 17B:
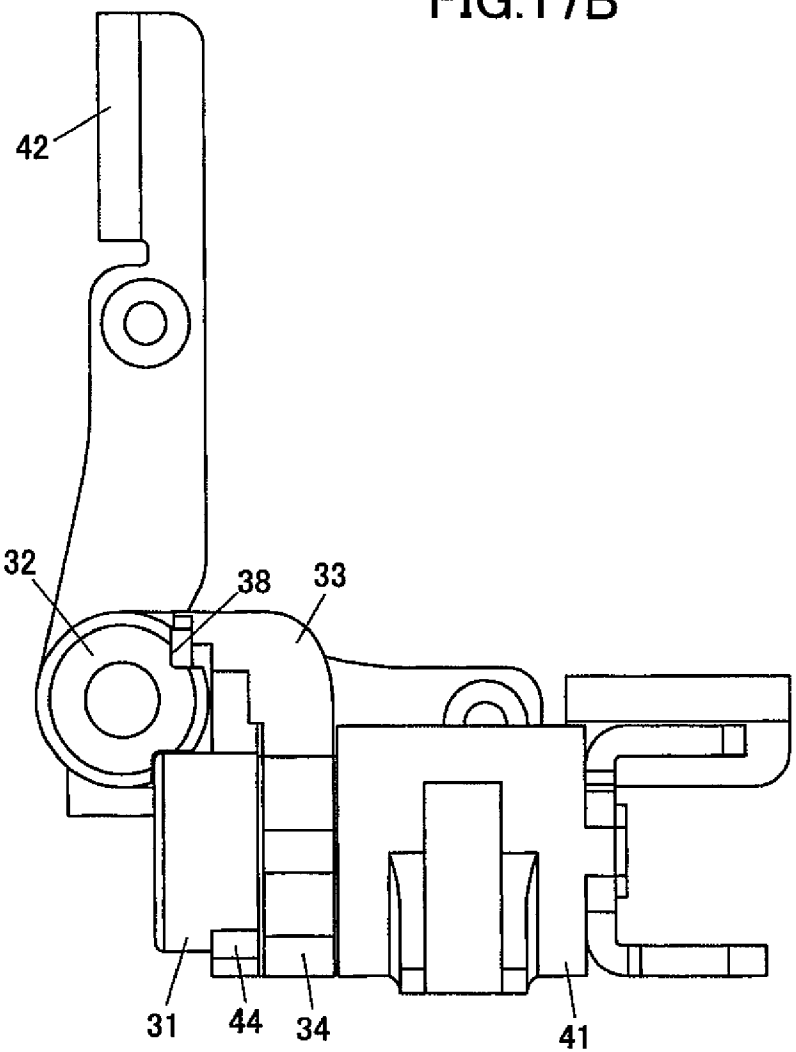
FIG. 17B is a front view showing the hinge mechanism rotated in the horizontal direction and corresponding to FIG. 15B.
Figure 17A:
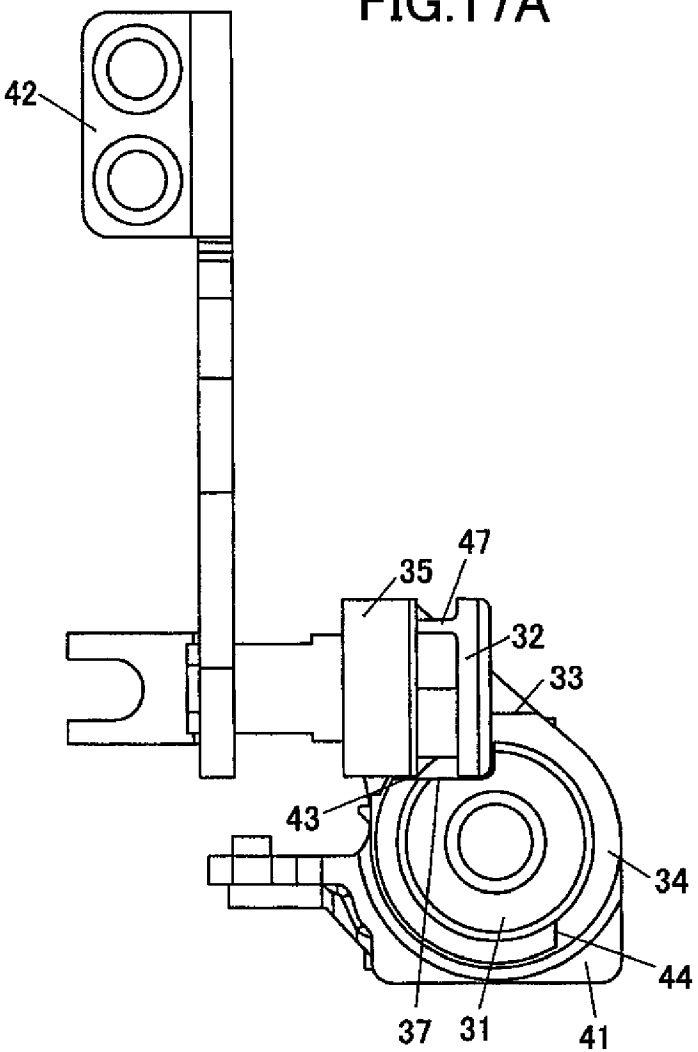
FIG. 17A is a side view showing the hinge mechanism rotated in the horizontal direction and corresponding to FIG. 15A.

FIGS. 15A and 15B show respective parts of the biaxial hinge member 3 in the folded state. FIGS. 16A and 16B show respective parts of the biaxial hinge member 3 opened at right angles in the vertical direction. FIGS. 17A and 17B show respective parts of the biaxial hinge member 3 opened at a right angle in the horizontal direction.

Figure 18:
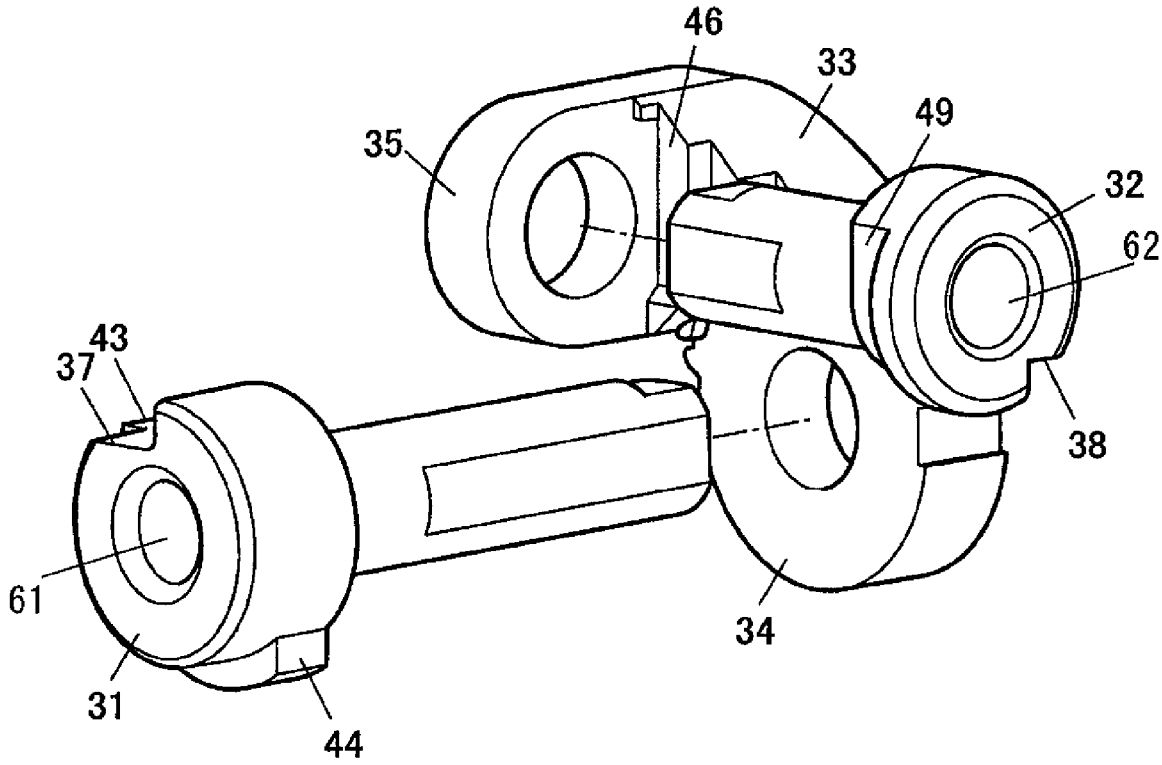
FIG. 18 is an exploded perspective view showing a relationship among a first rotational shaft, a second rotational shaft, and a coupling member.
Figure 19A:
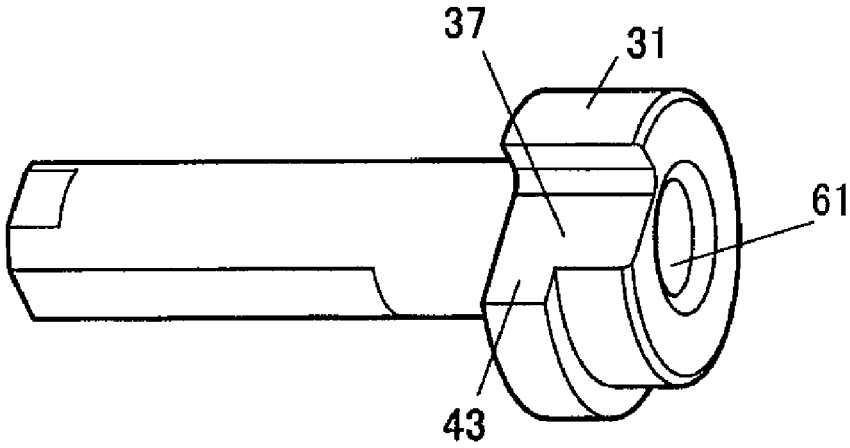
FIG. 19A is a part drawing showing the first rotational shaft.
Figure 19B:
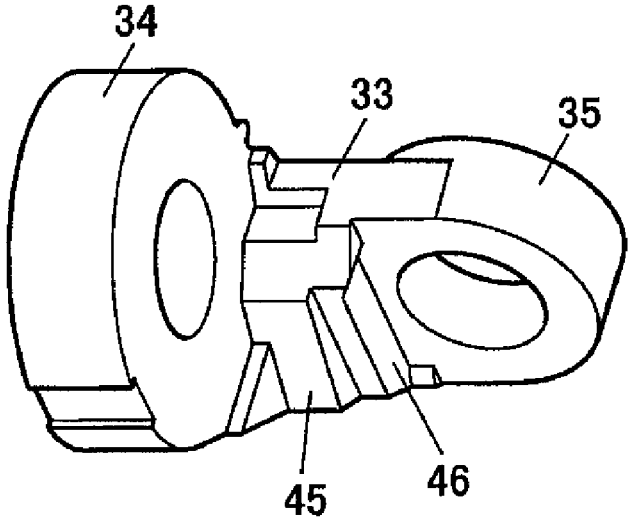
FIG. 19B is a part drawing showing the coupling member.
Figure 19C:
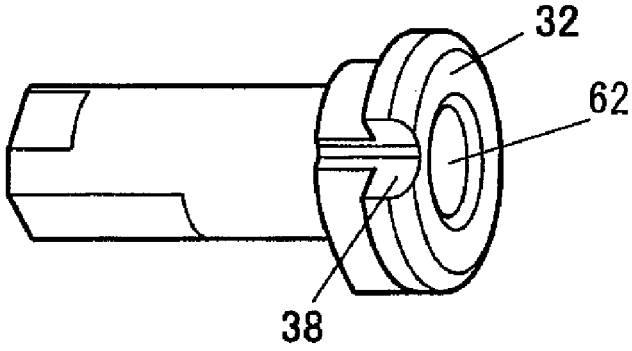
FIG. 19C is a part drawing showing the second rotational shaft.
Figure 20:
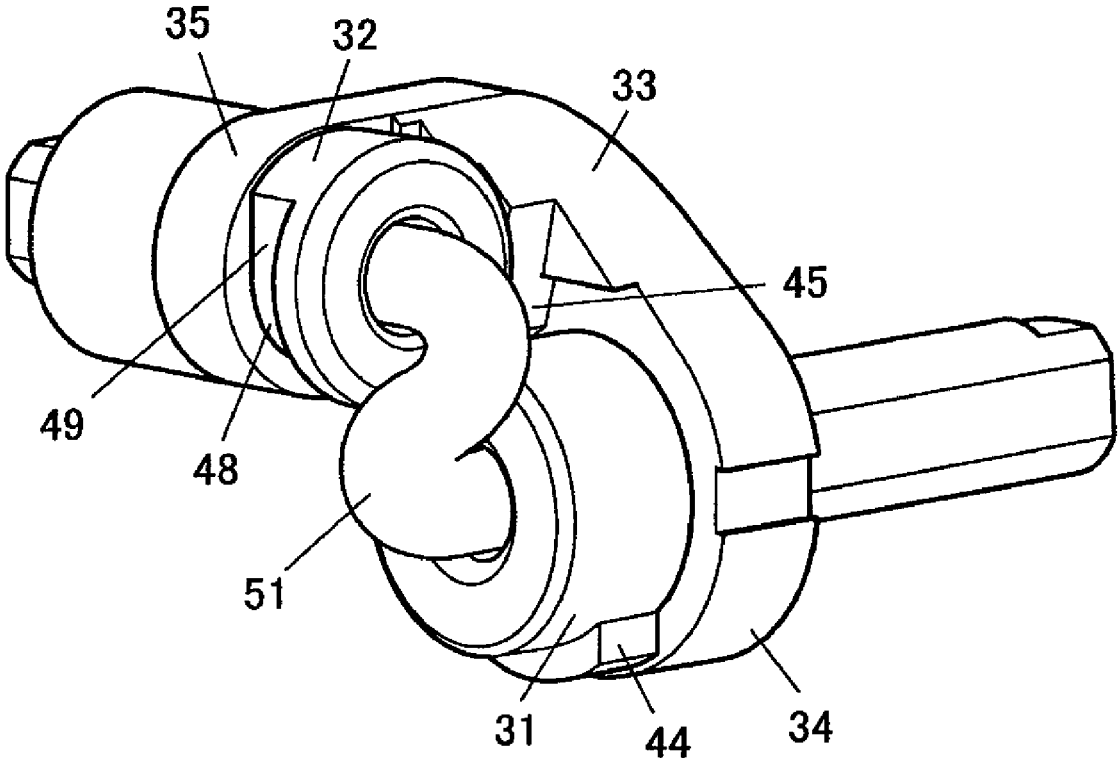
FIG. 20 is a perspective view showing the individual parts assembled together with wiring.

FIG. 18 shows the relationship among the first rotational shaft 31, the second rotational shaft 32, and the coupling member 33 in an exploded state. FIGS. 19A to 19C individually show those parts in an exploded state. As shown in the figures, the first rotational shaft 31 and the second rotational shaft 32 are hollow. A wiring 51 passes through a hollow part 61 of the first rotational shaft 31 and a hollow part 62 of the second rotational shaft 32 in an assembled state shown in FIG. 20. Note that the wiring 51 is not illustrated in the other figures.

As explained above, according to the first embodiment, the rotation of the first rotational shaft 31 and that of the second rotational shaft 32 intersecting at right angles with respect to each other can be restricted with a simple structure with the notches 37, 38 that the engagement part 36 comprises, without increasing a size.

The open state of the first casing 1 and the second casing 2 can be restricted with a structure other than the internal mechanism of the biaxial hinge member 3.

Figure 21:
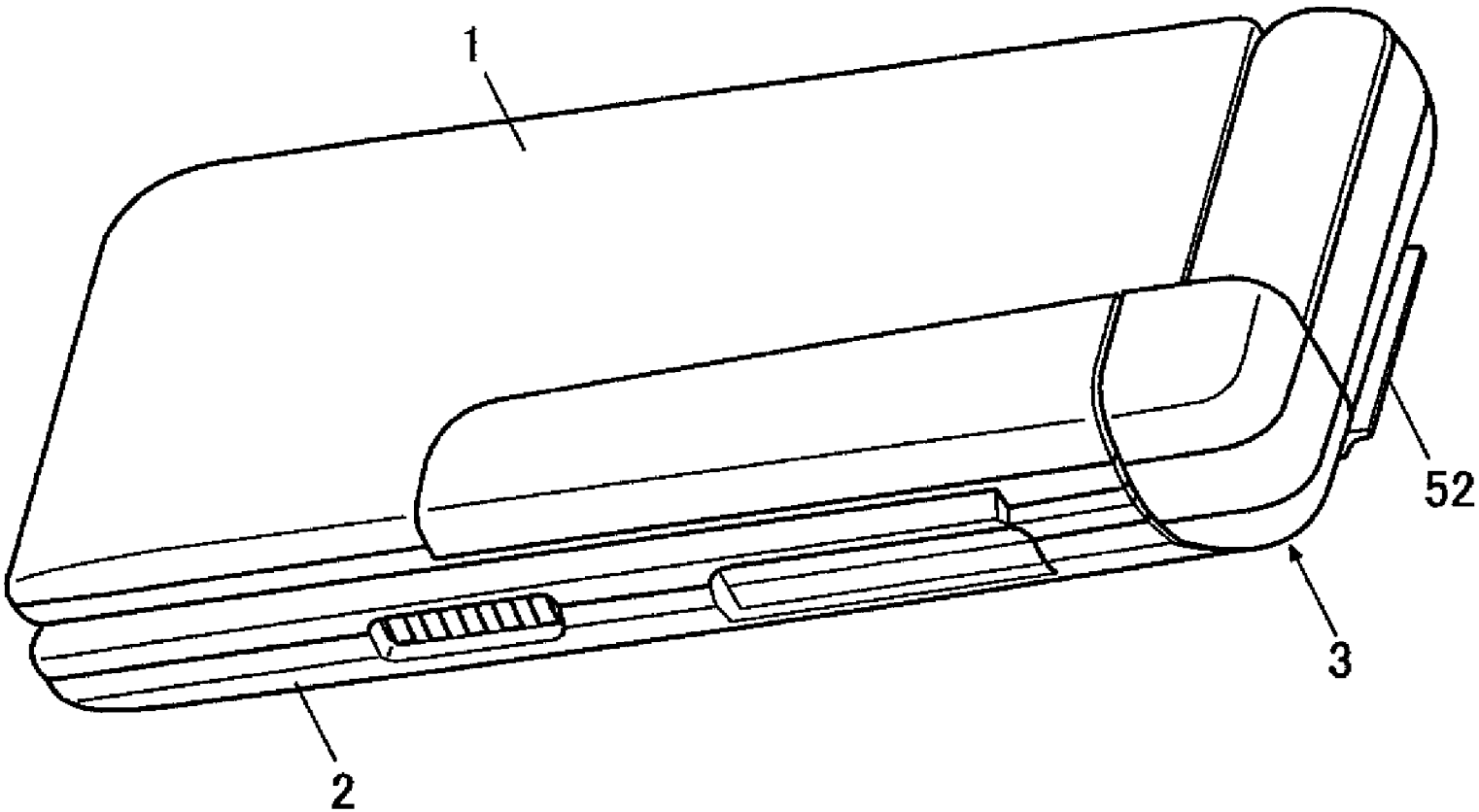
FIG. 21 is a perspective view showing the cellular phone device as viewed from a direction of an arrow XXI shown in FIG. 1.
Figure 22:
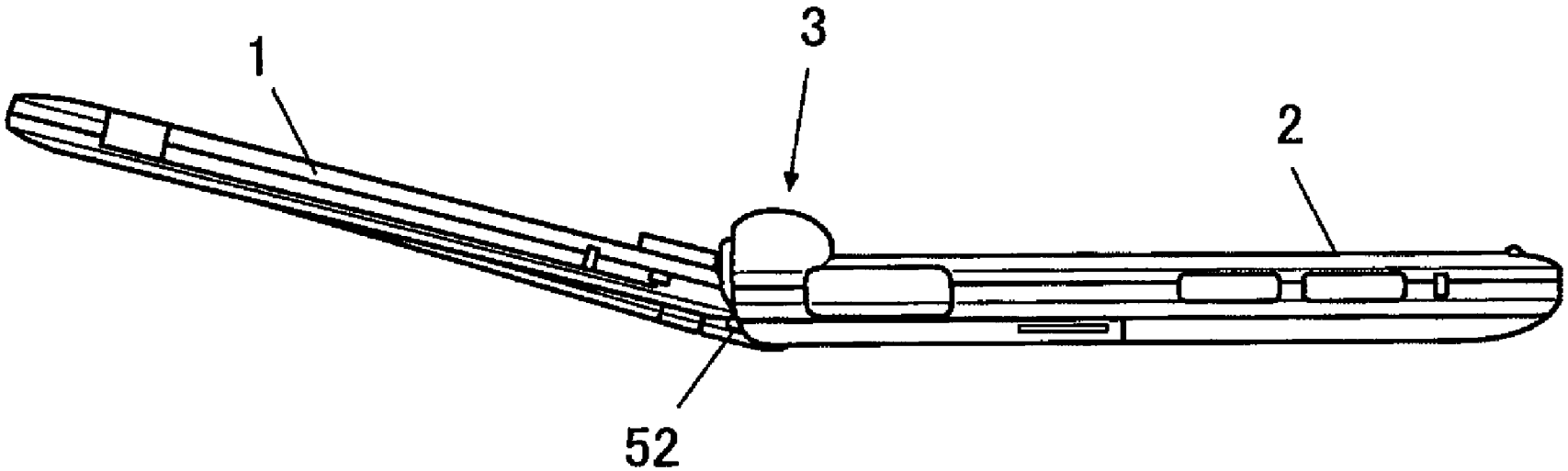
FIG. 22 is a side view showing the cellular phone device in FIG. 21 opened in the vertical direction.
Figure 23:
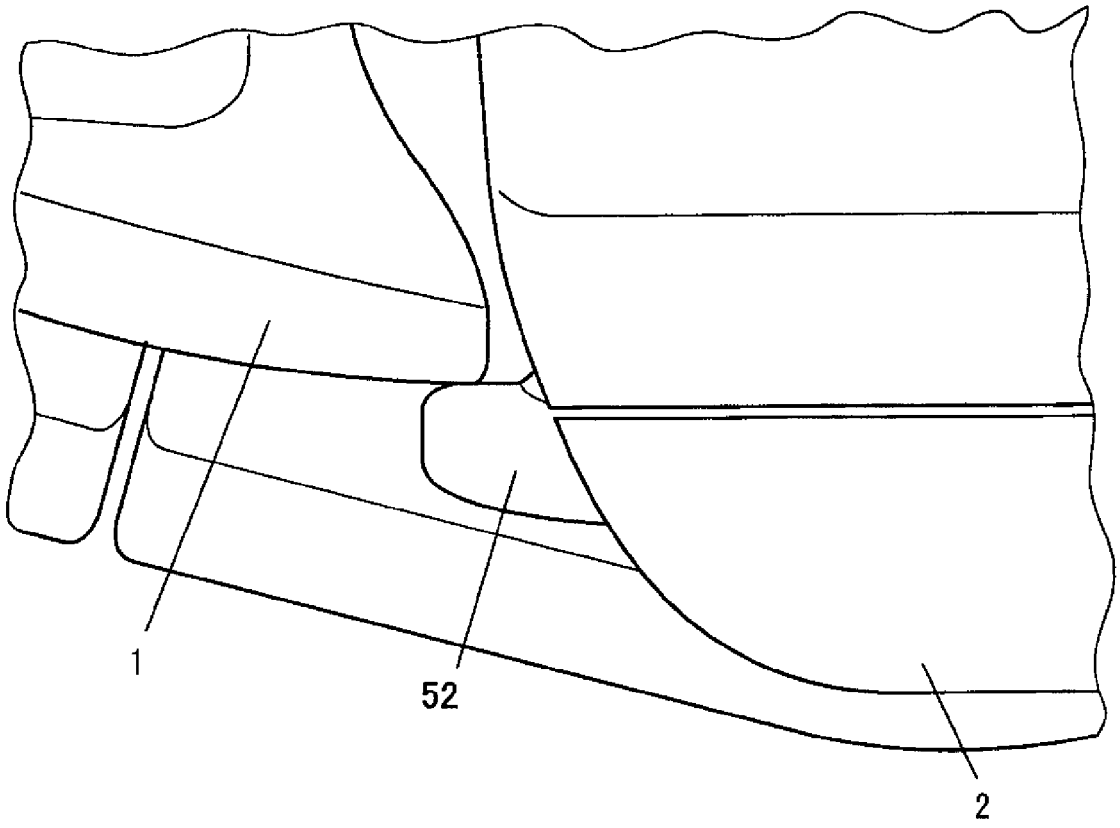
FIG. 23 is an enlarged view showing the center of FIG. 22.

As shown in FIG. 21, a wing 52 is protrudingly provided at the end portion of the second casing 2 on the biaxial hinge member 3 side. When the first casing 1 and the second casing 2 are opened in the vertical direction, as shown in FIGS. 22 and 23, the wing 52 abuts the end portion of the first casing 1 on the biaxial hinge member 3 side, and functions as a supporting stopper. As explained above, when the cellular phone device 100 is in the vertical-direction open state, the wing 52 protrudingly provided at the end portion of the second casing 2 on the biaxial hinge member 3 side functions as a stopper, in addition to the stopper function of the biaxial hinge member 3. Note that the illustrated example is for a case where the cellular phone device 100 is opened in the vertical direction, but the wing 52 may be provided for opening in the horizontal direction.

Second Embodiment

Figure 24:
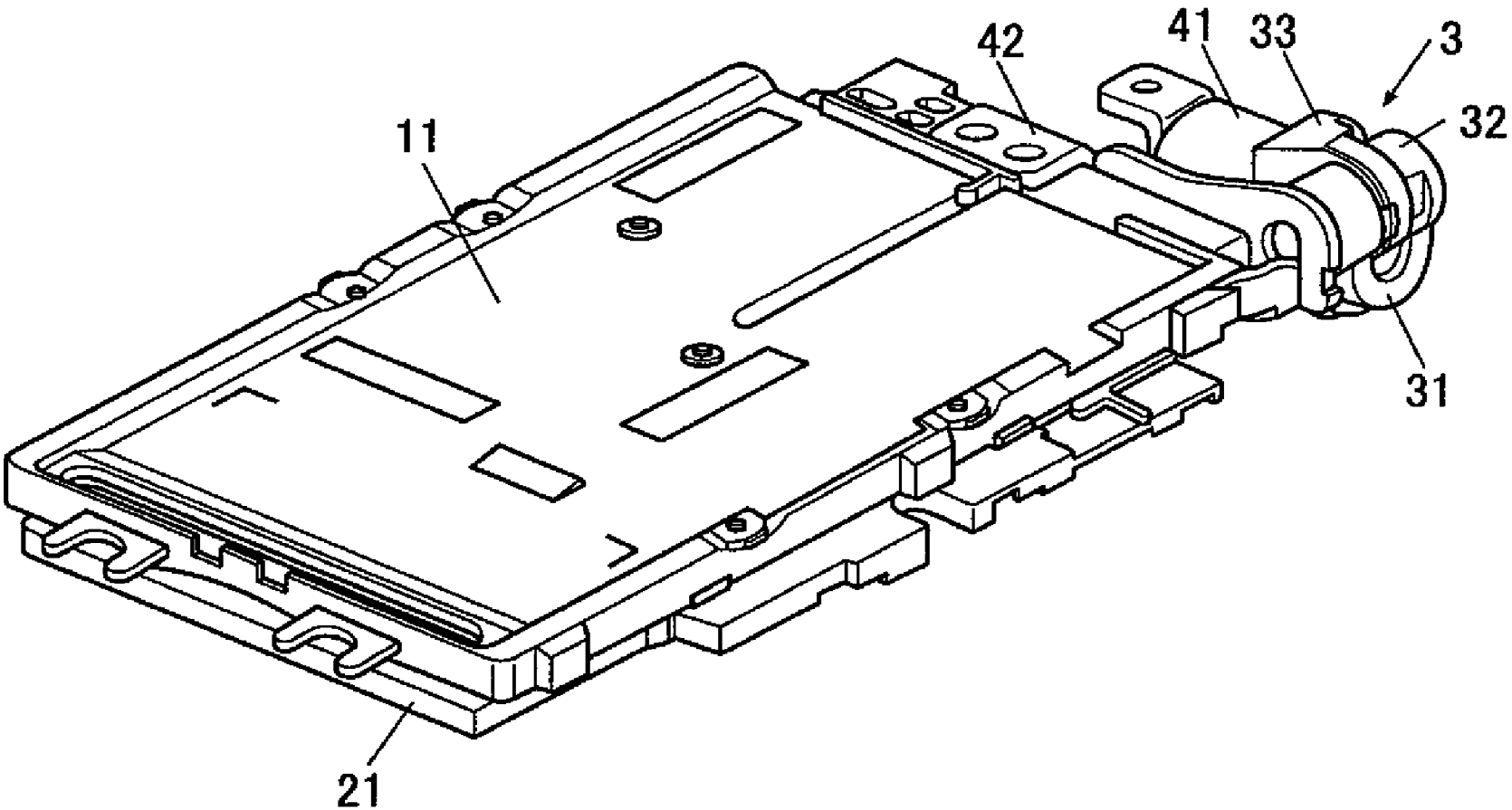
FIG. 24 is a perspective view showing the inner casing and the hinge mechanism in FIG. 4 as viewed from a direction of an arrow XXIV.
Figure 25:
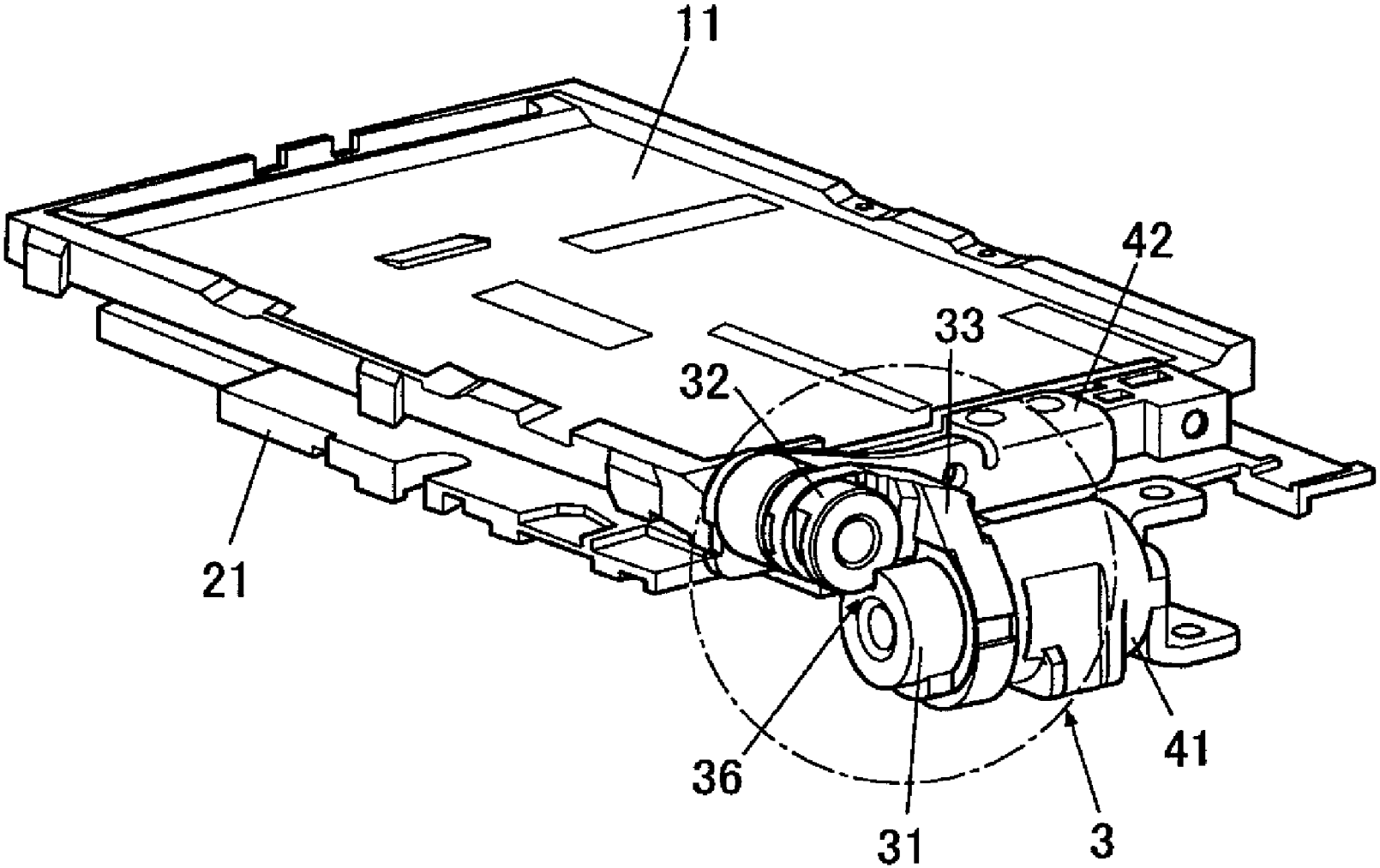
FIG. 25 is a perspective view showing the inner casing and the hinge mechanism in FIG. 4 as viewed from the direction of the arrow VII.
Figure 26:
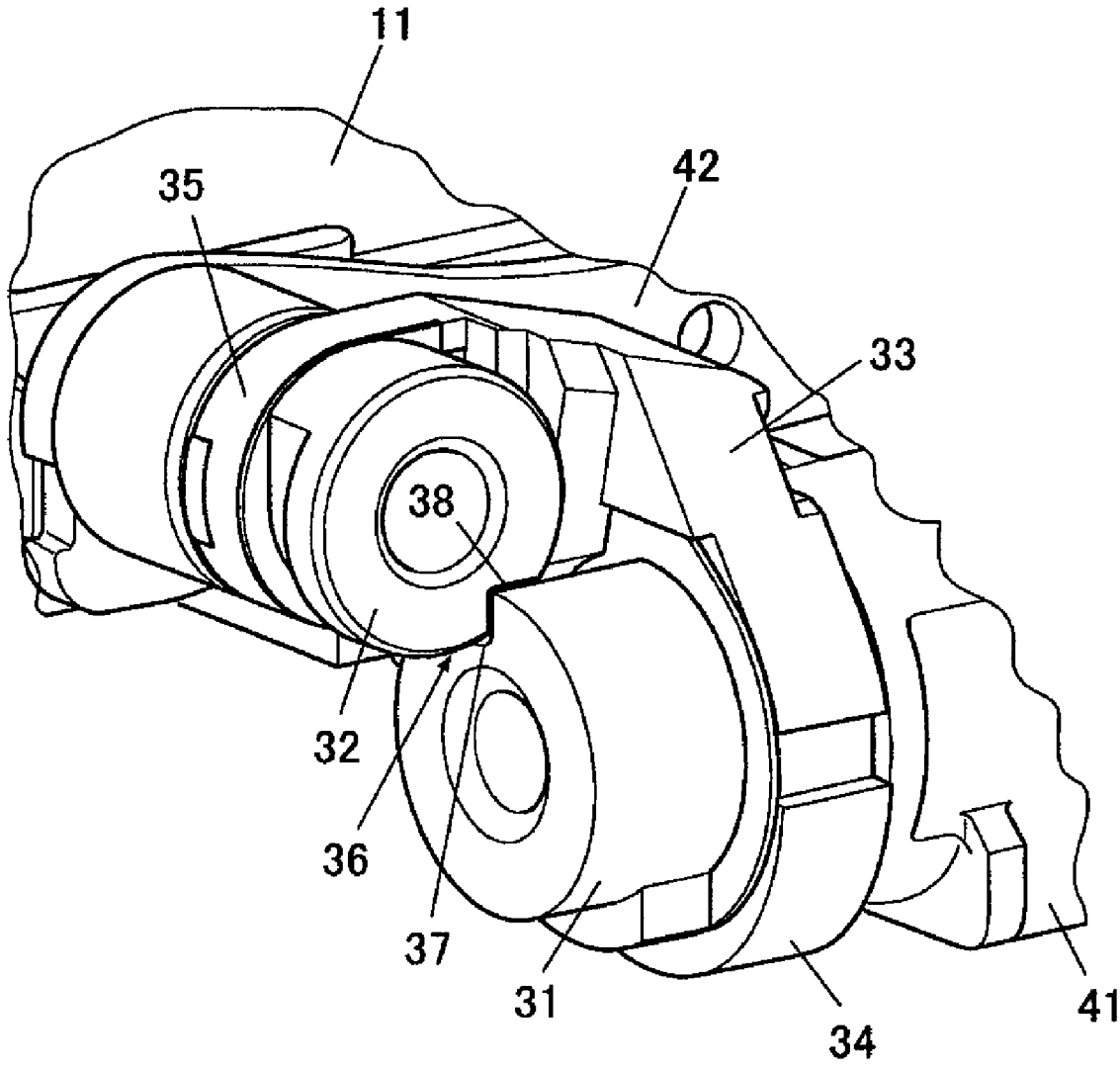
FIG. 26 is an enlarged view showing the hinge mechanism part of FIG. 25.

Next, an explanation will be given of another embodiment of the second rotational shaft 32. As shown in FIGS. 24 to 26, in a folded state, the notch 37 and the notch 38, both constituting the engagement part 36 face each other.

Figure 27:
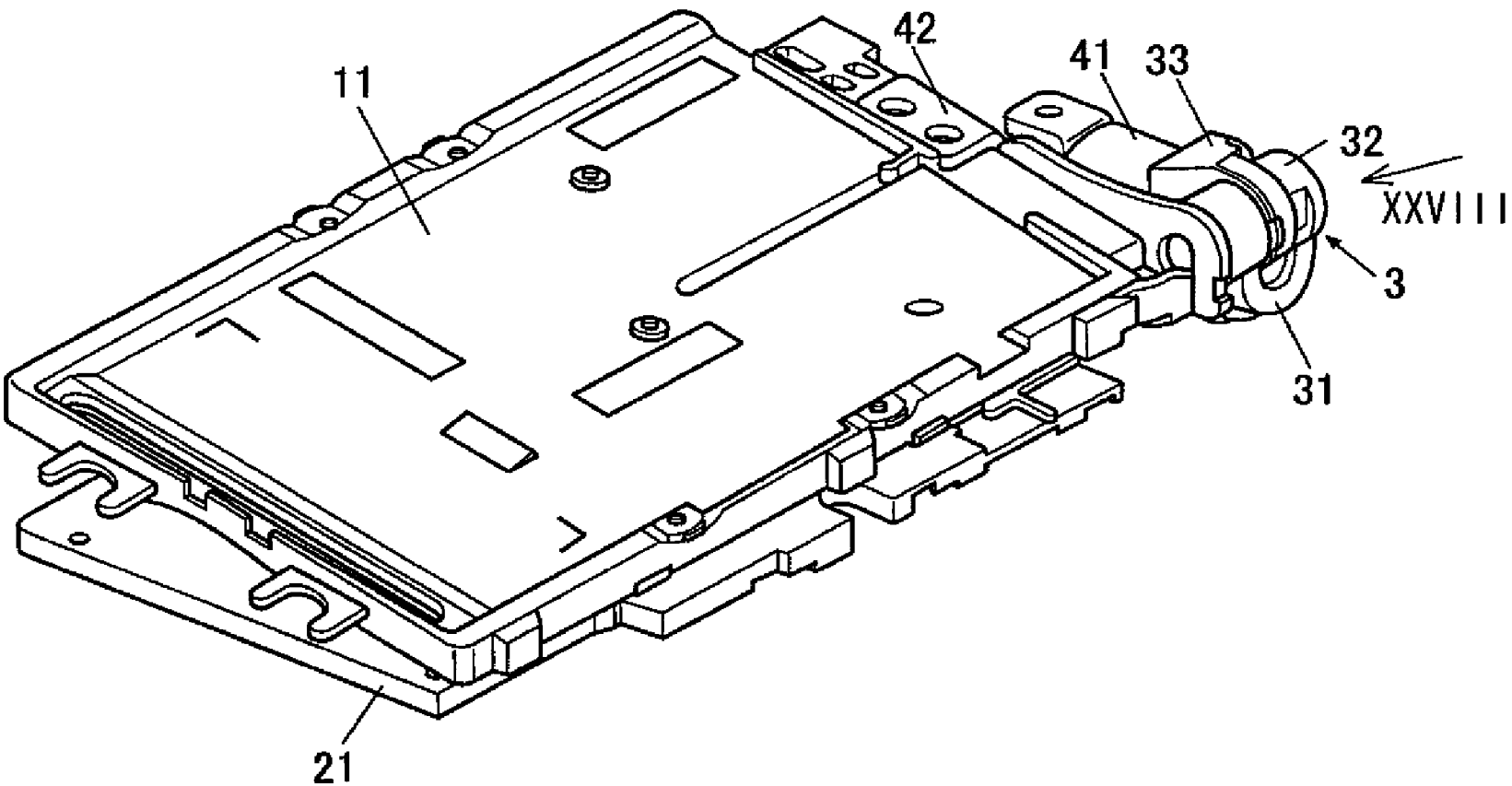
FIG. 27 is a perspective view showing the inner casing slightly opened from the state shown in FIG. 24.
Figure 28:
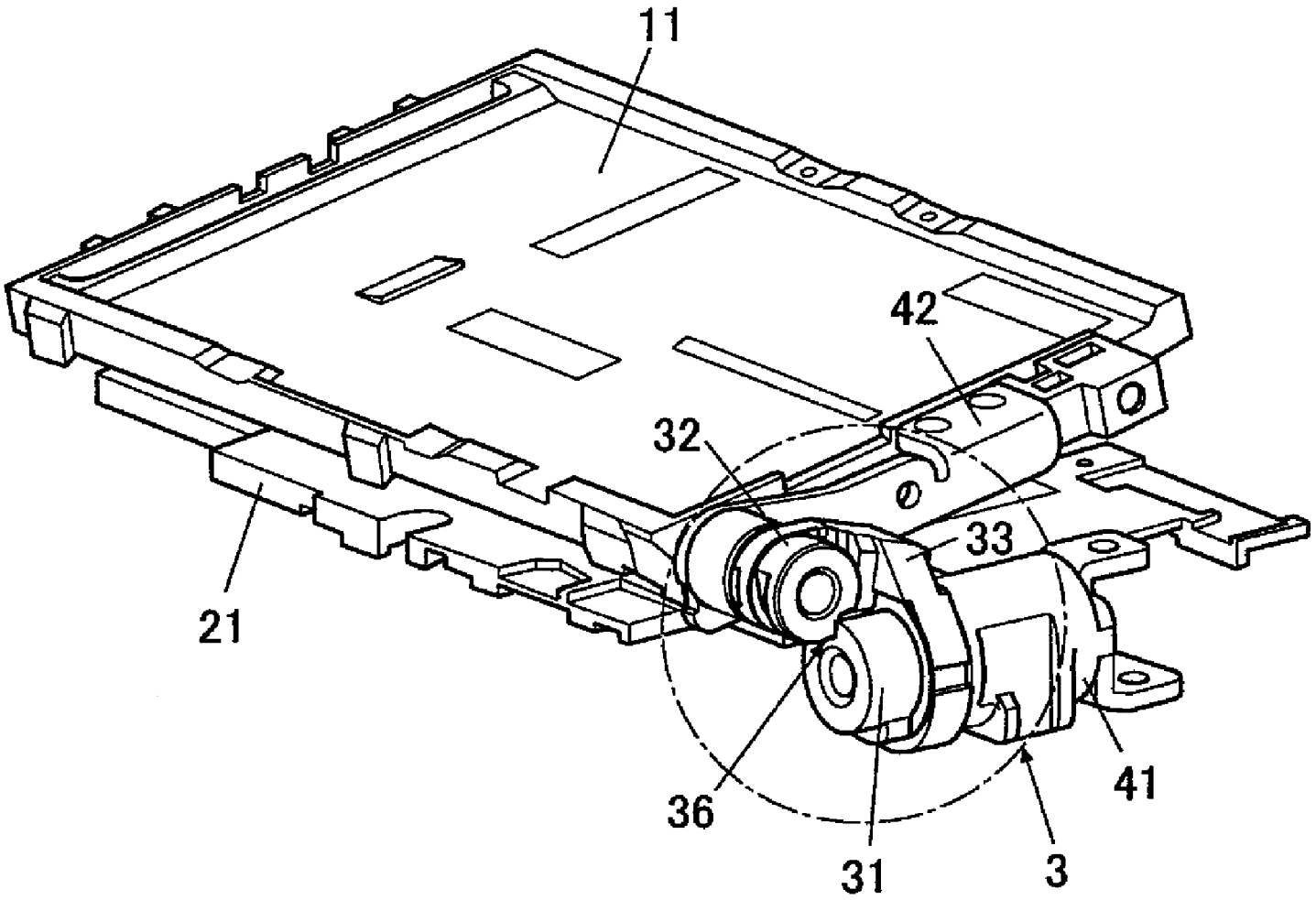
FIG. 28 is a perspective view showing the inner casing and the hinge mechanism in FIG. 27 as viewed from a direction of an arrow XXVIII.
Figure 29:
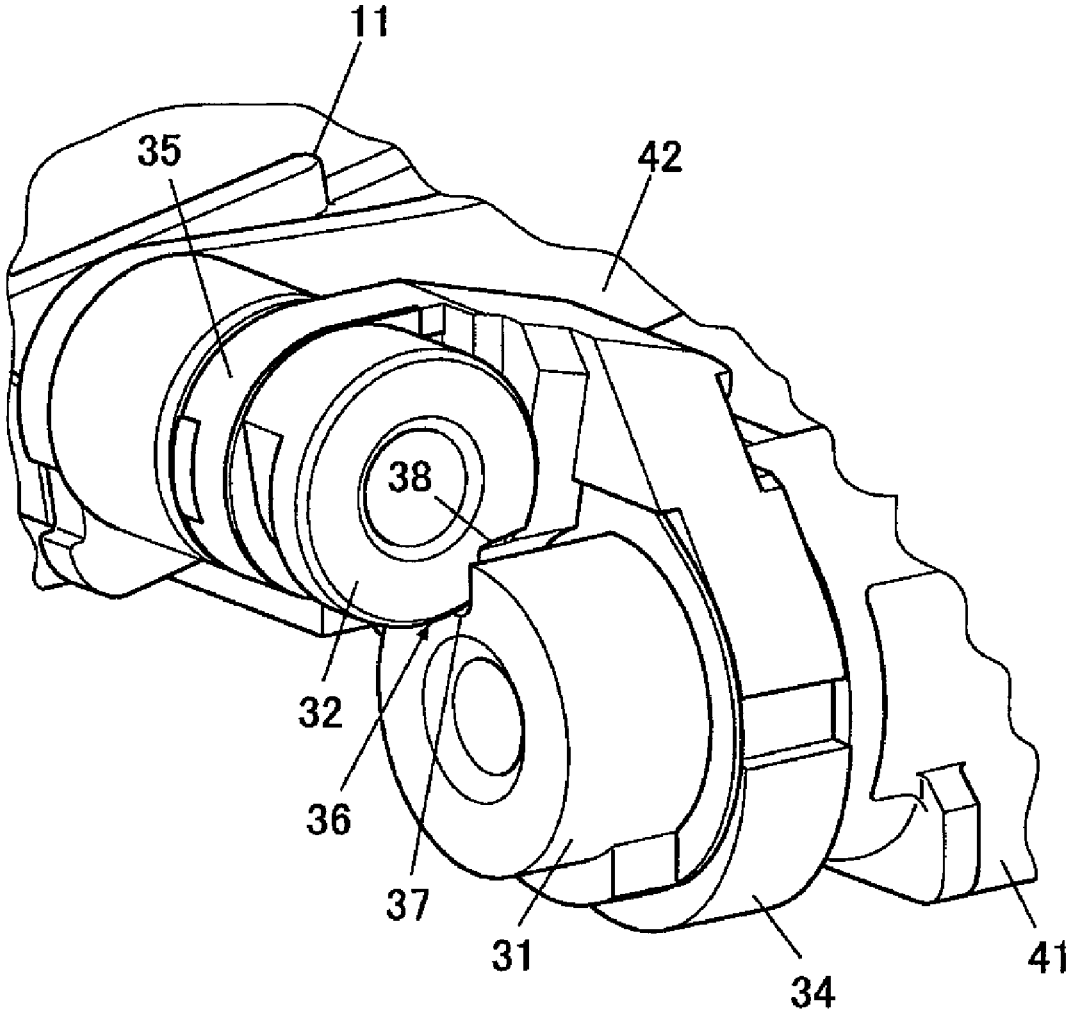
FIG. 29 is an enlarged view of the hinge mechanism part of FIG. 28.

In such a folded state, when a user attempts to open the casings in the vertical or horizontal direction, the user needs to insert a finger between the first casing 1 and the second casing 2. At this time, the casings slightly open in the horizontal direction in some cases. That is, as shown in FIGS. 27 and 28, the inner casing 11 and the inner casing 21 slightly open in the horizontal direction around the second rotational shaft 32 in some cases. In this case, as the notch 37 and the notch 38 interfere with each other, rotation may be restricted. That is, as shown in the enlarged view of FIG. 29, in the engagement part 36, the second rotational shaft 32 may be slightly inserted into the notch 37 of the first rotational shaft 31 through the notch 38. Accordingly, the cellular phone device 100 is locked so that it becomes impossible to open the casings neither in vertical nor in horizontal directions.

Figure 30:
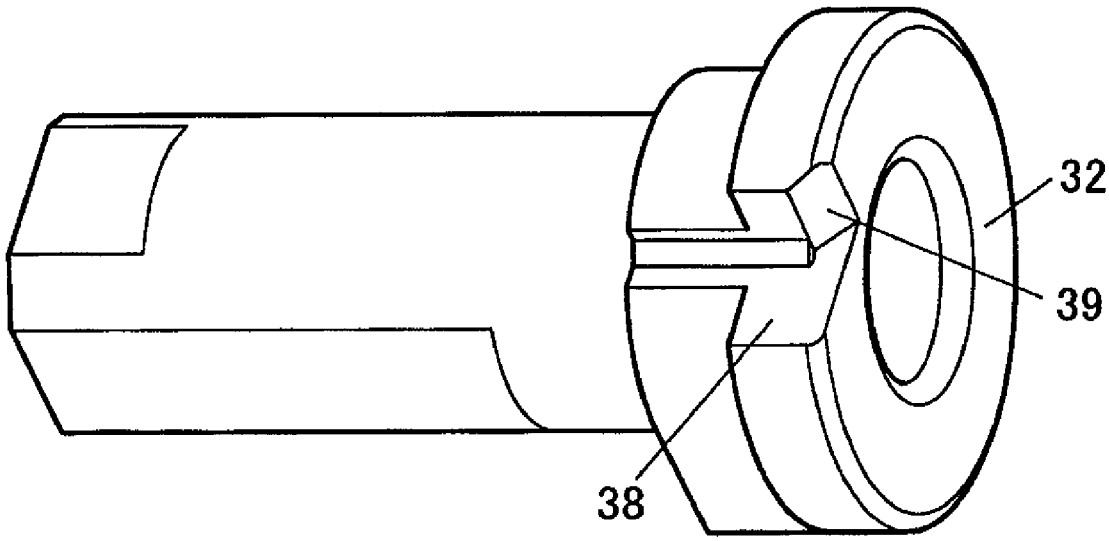
FIG. 30 is an enlarged perspective view showing another embodiment of the second rotational shaft.
Figure 31:
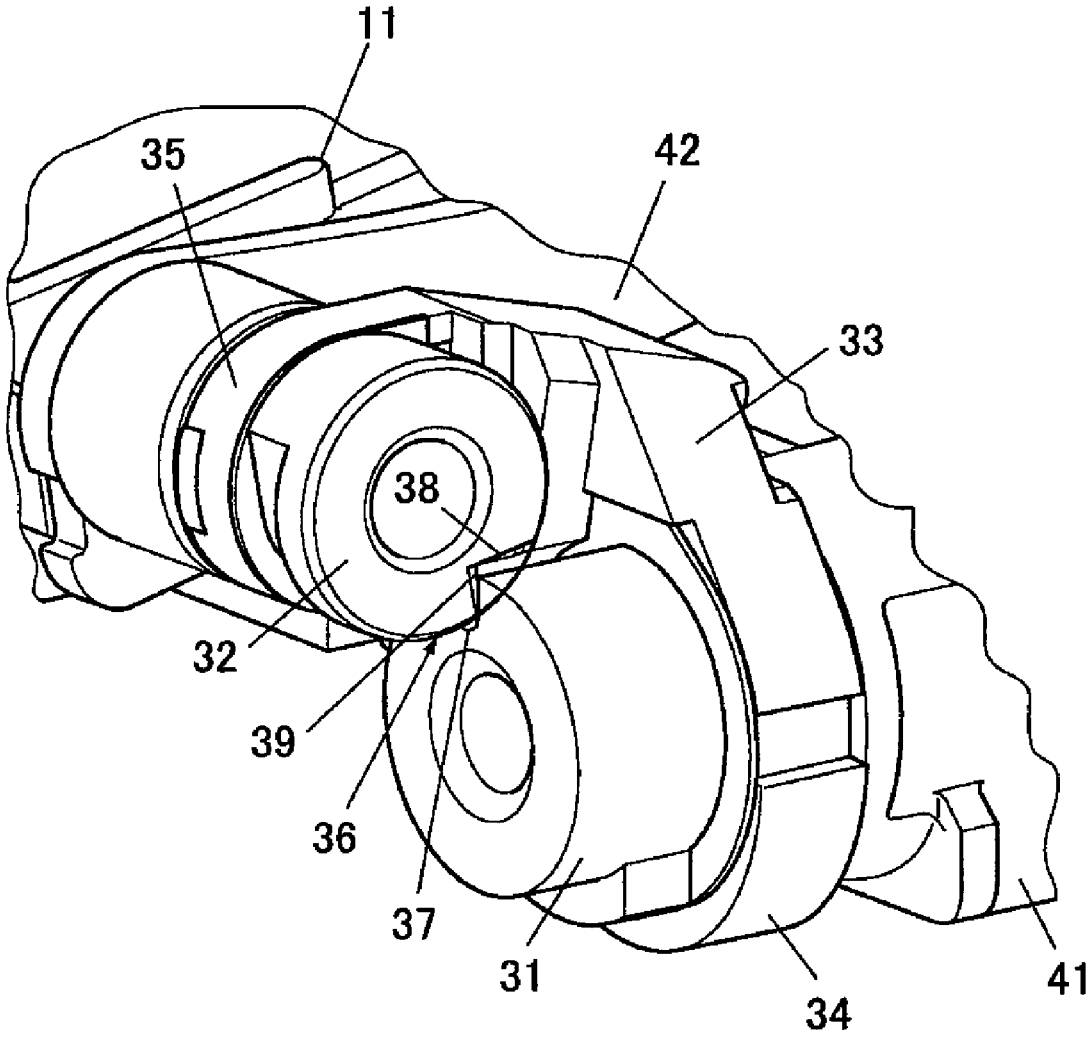
FIG. 31 is an enlarged perspective view showing a hinge mechanism part in which the second rotational shaft in FIG. 30 is embedded.

To avoid such a locked state, as shown in FIG. 30, at the notch 38 of the second rotational shaft 32, an inclined surface 39 is formed at the shaft end side. As shown in FIG. 31, the inclined surface 39 is formed as to be slightly opened in the horizontal direction, and is formed at a position where the second rotational shaft 32 is slightly inserted into the notch 37 of the first rotational shaft 31 through the notch 38.

Therefore, as explained above, even if the inner casing 11 and the inner casing 21 are slightly opened in the horizontal direction around the second rotational shaft 32, the first rotational shaft 31 is inserted into the notch 38 of the second rotational shaft 32 through the inclined surface 39. Accordingly, it becomes possible to open the casings in the vertical direction around the first rotational shaft 31.

Modified Examples

In the foregoing embodiments, a biaxial hinge mechanism which opens the first casing and the second casing in the vertical and horizontal directions, respectively, from a state where the casings are folded down is employed. However, the present invention can be applied to a biaxial hinge mechanism which allows the first and second casings to rotate in a state where the casings are opened from the folded state. Hereinafter, a modified example of the hinge mechanism will be explained.

A cellular phone device 200 of the modified example has the biaxial hinge member 3 employing a structure shown in FIG. 32. An intermediate member 6 is assembled in a foldable manner in the vertical direction via the first rotational shaft 31 above the second casing 2. The first casing 1 is assembled in a rotatable manner in the horizontal direction via the second rotational shaft 32 around the center of the intermediate member 6. When the casings are opened, the second casing 2 and the intermediate member 6 are relatively rotated in the vertical direction around the first rotational shaft 31. With the casings being opened, the first casing 1 and the intermediate member 6 can be relatively rotated in the horizontal direction around the second rotational shaft 32.

FIG. 33 shows another structure of the biaxial hinge member. The intermediate member 6 in FIG. 33 is L-shaped as viewed from the side of the cellular phone device 200. The first rotational shaft 31 is positioned at the middle of both of the principal surfaces of the second casing 2 in the thickness direction thereof. The other structures are the same as those in FIG. 32. The biaxial hinge member 3 can operate like the example shown in FIG. 32. As explained above, the first rotational shaft 31 and the second rotational shaft 32 may be disposed in an offset manner.

FIG. 34 shows the further other structure of the rotational shaft of the biaxial hinge member. The first rotational shaft 31 is disposed at the middle of both of the principal surfaces of the second casing 2 in the thickness direction of the second casing 2. The intermediate member 6 is assembled in a foldable manner to the second casing 2 through the first rotational shaft 31. The relationship between the intermediate member 6 and the first casing 1 is the same as that in the examples shown in FIGS. 32 and 33. According to the example shown in FIG. 34, when the casings are folded, the first casing 1 and the second casing 2 are folded as to overlap with each other as viewed from the illustrated direction.

Other Modified Examples

In the foregoing embodiments, the explanation has been given of the case where the electronic device is a cellular phone device, but the present invention is not limited to this case. The present invention can be applied to all foldable electronic devices, such as a desktop calculator, an electronic dictionary, a digital camera, a video camera, a PDA (Personal Digital Assistant), a laptop computer, and a wearable computer.

The first and second casings may have any kinds of functions, and for example, both casings may have touch panels, respectively.

The second rotational shaft may be separated into plural pieces.

The structures of the casings, rotational shafts, and coupling member are optional. For example, in the foregoing embodiments, the explanation has been given of the casings which basically open in the vertical direction, but casings which basically open in the horizontal direction may have the hinge apparatus of the present invention. In this case, by interchanging the definitions "vertical direction" and "horizontal direction", the operation of the biaxial hinge mechanism can be explained like the foregoing embodiments.

It is needless to say that the specific details may be changed and modified in various forms appropriately.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2007-312650 filed on Dec. 3, 2007 and including specification, claims, drawings and summary. The disclosure of the above Japanese Patent Application is incorporated herein by reference in its entirety.

What is claimed is:

1. A hinge apparatus comprising:

a first rotational shaft which rotates a first casing relative to a second casing in a vertical direction from a state where the first and second casings are folded down;

a second rotational shaft which rotates the first casing relative to the second casing in a horizontal direction;

a coupling member which couples the first rotational shaft and the second rotational shaft together perpendicularly such that an end portion of the first rotational shaft is overlapped with an end portion of the second rotational shaft; and an engagement member which restricts a rotation of the second rotational shaft by engagement of the first rotational shaft with the second rotational shaft when the first rotational shaft rotates, allows the rotation of the second rotational shaft when the first rotational shaft is in a first position, restricts a rotation of the first rotational shaft by engagement of the second rotational shaft with the first rotational shaft when the second rotational shaft rotates, and allows the rotation of the first rotational shaft when the second rotational shaft is in a second position;

wherein the first rotational shaft and the second rotational shaft respectively have hollows through which a wire passes.

2. The hinge apparatus according to claim 1, wherein the engagement member comprises notches respectively formed in the first rotational shaft and the second rotational shaft.

3. The hinge apparatus according to claim 2, wherein the notch formed in one rotational shaft of the first rotational shaft and the second rotational shaft engages with an end portion of the other rotational shaft and an outer circumference thereof, thereby restricting a rotation of the one rotational shaft when the other rotational shaft rotates.

4. The hinge apparatus according to claim 2, wherein the each of the notches has an inclined surface formed in the end portion of the rotational shaft.

5. The hinge apparatus according to claim 1, further comprising stoppers which are respectively provided on the first rotational shaft, the second rotational shaft, and the coupling member, and restrict rotational ranges of the first casing and the second casing between the folded state and open state in the vertical and horizontal directions by engagement of outer circumferences of the first rotational shaft and the second rotational shaft with the coupling member.

6. The hinge apparatus according to claim 1, wherein the first rotational shaft and the second rotational shaft respectively have attachment parts to fix the first rotational shaft and the second rotational shaft to the first casing and the second casing, respectively.

7. A foldable electronic device which can fold down a first casing and a second casing, comprising the hinge apparatus according to claim 1.

8. A hinge apparatus comprising:

a first rotational shaft which rotates a first casing relative to a second casing in a vertical direction from a state where the first and second casings are folded down;

a second rotational shaft which rotates the first casing relative to the second casing in a horizontal direction;

a coupling member which couples the first rotational shaft and the second rotational shaft together in a perpendicular manner so that an end portion of the first rotational shaft is overlapped with an end portion of the second rotational shaft;

an engagement member which restricts a rotation of the second rotational shaft by engagement of the first rotational shaft with the second rotational shaft when the first rotational shaft rotates, allows the rotation of the second rotational shaft when the first rotational shaft is in a first position, restricts a rotation of the first rotational shaft by engagement of the second rotational shaft with the first rotational shaft when the second rotational shaft rotates, and allows the rotation of the first rotational shaft when the second rotational shaft is in a second position; and stoppers respectively provided on the first rotational shaft, the second rotational shaft, and the coupling member, said stoppers restricting rotational ranges of the first casing and the second casing between the folded state and open states in the vertical and horizontal directions by engagement of outer circumferences of the first rotational shaft and the second rotational shaft with the coupling member.

9. The hinge apparatus according to claim 8, wherein the engagement member comprises notches respectively formed in the first rotational shaft and the second rotational shaft.

10. The hinge apparatus according to claim 9, wherein the notch formed in one rotational shaft of the first rotational shaft and the second rotational shaft engages with an end portion of the other rotational shaft and an outer circumference thereof, thereby restricting a rotation of the one rotational shaft when the other rotational shaft rotates.

11. The hinge apparatus according to claim 9, wherein each of the notches has an inclined surface in the end portion of the rotational shaft.

12. The hinge apparatus according to claim 8, wherein the first rotational shaft and the second rotational shaft respectively have attachment parts to fix the first rotational shaft and the second rotational shaft to the first casing and the second casing, respectively.

13. A foldable electronic device which can fold down a first casing and a second casing, comprising the hinge apparatus according to claim 8.

* * * * *